US006311373B1

(12) United States Patent
Hashimoto

(10) Patent No.: US 6,311,373 B1
(45) Date of Patent: Nov. 6, 2001

(54) INTERMEDIATE CLASP FOR BAND TYPE ORNAMENTS

(75) Inventor: Norio Hashimoto, Tanashi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/423,303

(22) PCT Filed: Mar. 10, 1999

(86) PCT No.: PCT/JP99/01163

§ 371 Date: Nov. 10, 1999

§ 102(e) Date: Nov. 10, 1999

(87) PCT Pub. No.: WO99/45812

PCT Pub. Date: Sep. 16, 1999

(30) Foreign Application Priority Data

Mar. 11, 1998 (JP) ..... 10-059265
Mar. 25, 1998 (JP) ..... 10-077160
Feb. 26, 1999 (JP) ..... 11-049389

(51) Int. Cl.[7] ..... A44B 11/25; A44C 5/18
(52) U.S. Cl. ..... 24/265 WS; 24/68 J; 24/71 J
(58) Field of Search ..... 24/265 WS, 71 J, 24/68 J, 583

(56) References Cited

U.S. PATENT DOCUMENTS 3,636,596 * 1/1972 Lizuka ..... 24/71 J
3,797,716 * 3/1974 Mochizuki ..... 24/265 WS
3,900,934 * 8/1975 Luft et al. ..... 24/71 J
4,158,904 * 6/1979 Learn ..... 24/265 WS
4,424,611 * 1/1984 Mori ..... 24/265 WS

FOREIGN PATENT DOCUMENTS 56-10172 3/1981 (JP) .
6-66329 9/1994 (JP) .

* cited by examiner

*Primary Examiner*—Victor N. Sakran
(74) *Attorney, Agent, or Firm*—Dennison, Scheiner, Schultz & Wakeman

(57) ABSTRACT

A buckle is formed by an upper plate (33) pivotally connected to an end of a first band, and a lower plate (35) and pivotally connected to the upper plate, and a slidable frame (40) pivotally connected to an end of the lower plate. A push plate (43) is attached to the slidable frame so that a second band (36) can be inserted in the space between the push plate and a bottom plate (38), and a pushing projection (48) is formed at an end of the lower plate for pressing the push plate to the second band. A stopper rod (50) is provided in the slidable frame so as to abut against the pushing projection at a position where the pushing projection strongly presses the push plate, thereby preventing the lower plate from rotating downwardly over the slidable frame fixing position.

21 Claims, 23 Drawing Sheets

INTERMEDIATE CLASP FOR BAND TYPE ORNAMENTS

TECHNICAL FIELD

The present invention relates to a buckle for a personal adornment band, and more particularly to a buckle referred to as a double-fold buckle, wherein the length of a band is adjustable, and to a watch provided with the buckle.

BACKGROUND ART

The double-fold buckle capable of adjusting the effective length of bands comprising a first band and a second band comprises an upper plate pivotally connected to the first band, a lower plate rotatably connected to the other end of the upper plate, and a band length adjusting buckle pivotally connected to the other end of the lower plate and secured to the second band.

Japanese Utility Model Publication 56-10172 discloses the above-described double-fold buckle.

FIG. 22 is a sectional view of the double-fold buckle disclosed in Japanese Utility Model Publication 56-10172. The buckle comprises an upper plate 3 rotatably connected to an end of a band 1 by a pin 2, an lower plate 4 connected to the other end of the upper plate 3 by a pin, and a band length adjusting buckle 6 slidably mounted on the other band 5.

The band length adjusting buckle 6 has a slidable frame 10 comprising a bottom plate 7 and side walls 8 extending from both sides of the bottom plate, and a push plate 13 having a pair of supporting lugs 12 each of which is inserted in an elongated hole 11 formed in the side wall 8 with a slight play in the vertical direction. The push plate 13 is adapted to lightly abut on the other band so that the slidable frame 10 may slide along the band.

An end of the push plate 13 is bent to form an engaging portion 14. The length adjusting buckle 6 further has a cover 16 pivotally connected to the end of the upper plate 3 by a pin 15. The upper and lower plates 3 and 4 are folded and an engaging hook 17 projecting from the cover 16 is engaged with the engaging portion 14 so that the diameter of the band can be decreased to render the watch to be worn on a wrist.

In addition, the end of the lower plate 4 is bent downward to form a V shape, thereby forming a pushing projection 18. As shown in FIG. 22, when the lower plate 4 of the buckle is rotated away from the other band 5, the pushing projection 18 is disengaged from the push plate 13 to release the plate. Hence the length adjusting buckle 6 can be moved on the band 5, thereby enabling to adjust the effective length of the band in accordance with the size of the wrist.

After the length is adjusted, the lower plate 4 is rotated toward the band 5 so that the pushing projection 18 depresses the push plate 13, thereby to abut the push plate against the band 5. Hence the length adjusting buckle 6 can be attached to the band. At that time, a pair of lugs 19 projecting from both sides of the lower plate engage with grooves 20 formed in the side walls 8 so that the lower plate 4 is prevented from rising.

In such a buckle, depending on the manner in which the watch is worn, especially when releasing the cover 16 from the engaging portion 14, a large force is exerted, so that the lower plate 4 may further be rotated in the clockwise direction in FIG. 22 from the push plate depressing state. When the lower plate 4 is thus rotated, the pushing projection 18 leaves the push plate 13 at the opposite end, thereby releasing the length adjusting buckle 6 from the band 5. Thus there may occur an accident where the band is released from the wrist, and the watch falls off.

Moreover, since the lugs 19 are engaged with the grooves 20, it is difficult to raise the lower plate 4 while wearing the watch to adjust the length of the band. Instead, the watch must be taken off from the wrist and the connecting plates must be rotated using such a tool as a screwdriver. Thus the adjusting operation is troublesome. In addition, since the plates are forced to rotate using the tool, the members such as the lower plate may be deformed. As a result, if the length is frequently adjusted in accordance with the daily changes of the size of the wrist so that the watch may be comfortably worn, the buckle may break and loose its function as a buckle.

Furthermore, the lugs 19, which project out from the side walls 8, may injure the cuffs of the clothes.

Moreover, the relative positions of the pushing projections 18 and the upper and lower plates 3 and 4 must be accurately set to obtain the predetermined effect, thus rendering the manufacture difficult.

FIGS. 23 and 24 show a conventional buckle disclosed in Japanese Utility Model Application Laid-Open 6-66329. The buckle is provided with a lock mechanism comprising a slidable frame 22 in which a band 21*a* is inserted, and a cover 24 connected to the other band 21*b*.

A pair of opposite holes 26*a* are formed in side walls 26 of the slidable frame 22. In a guide housing 27, there are disposed a pair of push buttons 28 and a pair of springs (not shown). The guide housing 27 is disposed in the slidable frame 22 so as to project a pair of manipulating portions 28A of the push button from holes 26*a*.

The slidable frame 22 is further provided with a support pin 23 fixed to the side walls 26. A band fixing hook 25 is rotatably mounted on the support pin 23. The band fixing hook 25 presses the band 21*a* by way of a push plate 25*a* which is movably held in a direction of the thickness of the band, thereby pressing the band 21*a*. Thus, the band 21*a* is fixed at an arbitrary position with respect to the slidable frame 22.

A substantially T-shaped hook 24*a* projects from the underside of the cover 24. The hook 24*a* engages engaging portions (not shown) of the push buttons 28 which are urged by the spring, thereby fastening the cover 24 to the slidable frame 22.

When the manipulating portions 28A of the push buttons 28 are depressed against the urging of the spring, each engaging portion of the push buttons 28 is disengaged from the hook 32 so that the cover 24 and the slidable frame 22 are released from one another. A coil spring 29 is wound around a connecting shaft for coaxially connecting the cover 24, the other band 23 and a band connecting hook for urging the cover 24 in the opening direction. Thus, the cover 24 is automatically opened from the slidable frame 22.

In the above-described buckle, the spring 29 is exposed so that the appearance of the personal adornment band is deteriorated.

An object of the present invention is to provide a buckle for a personal adornment band where the watch is prevented from falling off, the length of the band is easily adjusted, and which does not injure the clothes of the wearer, and is easy to manufacture.

Another object of the present invention is to provide a buckle wherein the spring means of the cover is not visible.

DISCLOSURE OF THE INVENTION

According to the present invention, there is provided a buckle for a personal adornment band comprising, at least an upper plate and a lower plate pivotally connected to an end of a first band, and pivotally connected to each other, a slidable frame having a bottom plate and pair of side walls formed on both side of the bottom plate and pivotally connected to an end of the lower plate, a pushing projection formed at an end of the lower plate for fixing the slidable frame to a second band, stopper means provided in the slidable frame so as to abut against the pushing projection at a position where the pushing projection fixes the slidable frame to the second band, thereby preventing the lower plate from rotating downwardly over the slidable frame fixing position.

The stopper means is provided at an outer position than the pushing projection.

The stopper means may be provided at an inner position than the pushing projection.

The stopper means is a rod securely mounted between the side walls of the slidable frame.

The stopper means may be a lock mechanism provided in the slidable frame.

A push plate is mounted on the slidable frame so as to insert the second band in a space between the bottom plate of the slidable frame and the push plate, and the push plate is pressed onto the second band by the pushing projection.

Pushing means is provided on one of the lower plate and the push plate for pushing the push plate to the second band.

The pushing means is a ridge formed by bending the lower plate toward the push plate.

The lock mechanism comprises a guide housing fixed in the slidable frame, a cover mounted on the upper plate, a hook formed on the underside of the cover. projecting therefrom, a pair of push buttons slidably mounted in the guide housing and so disposed as to be depressible from the outside of the guide housing, a pair of springs for urging said push buttons outward, engaging portions provided on the push buttons for engaging with said hook, and a resilient member for urging the hook upward.

BEST MODE FOR EMBODYING THE INVENTION

Figure 1:
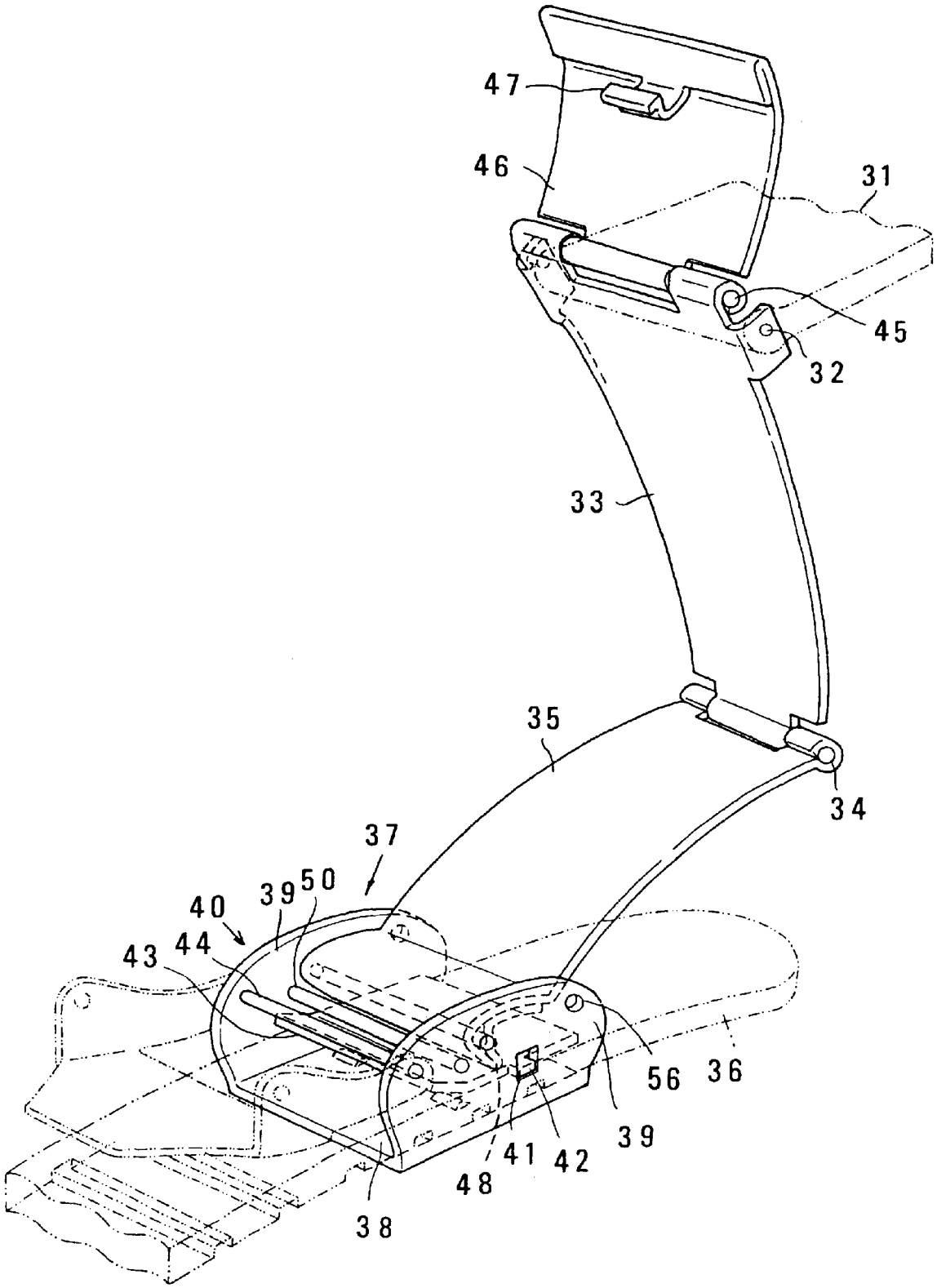
FIG. 1 is a perspective view showing a first embodiment of the present invention.
Figure 2:
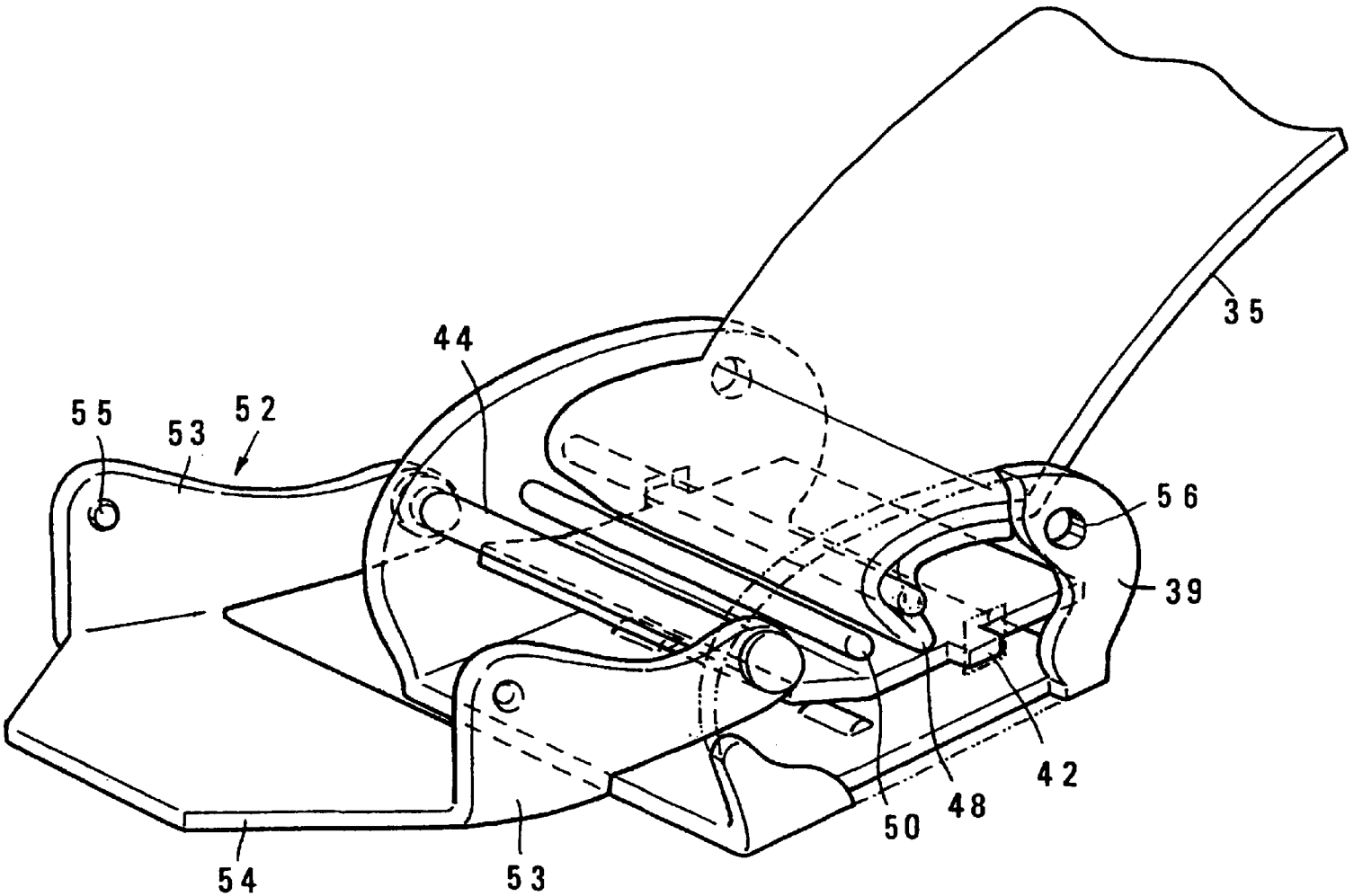
FIG. 2 is an enlarged perspective view of FIG. 1.
Figure 3:
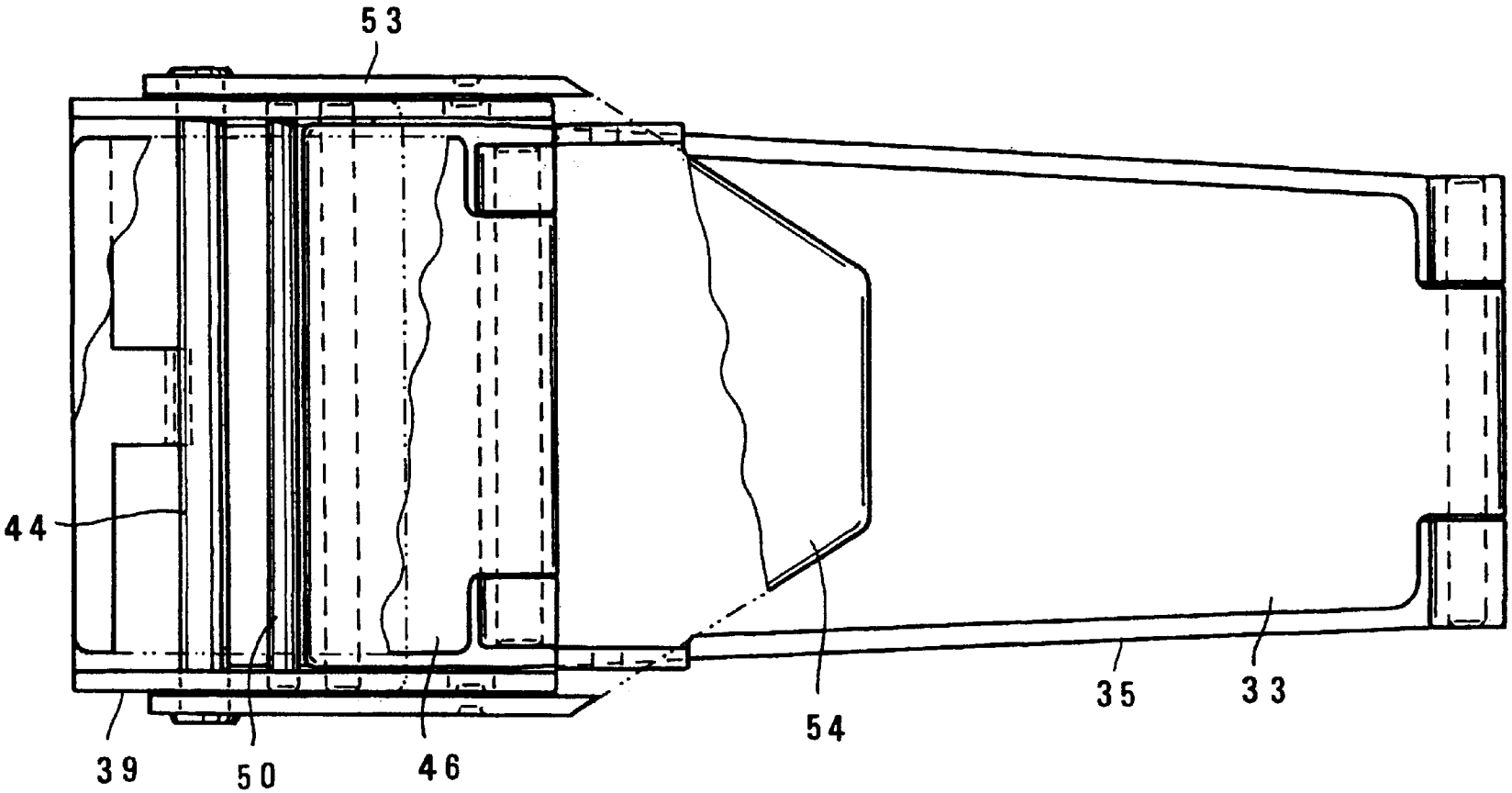
FIG. 3 is a plan view showing the embodiment of FIG. 1.
Figure 4:
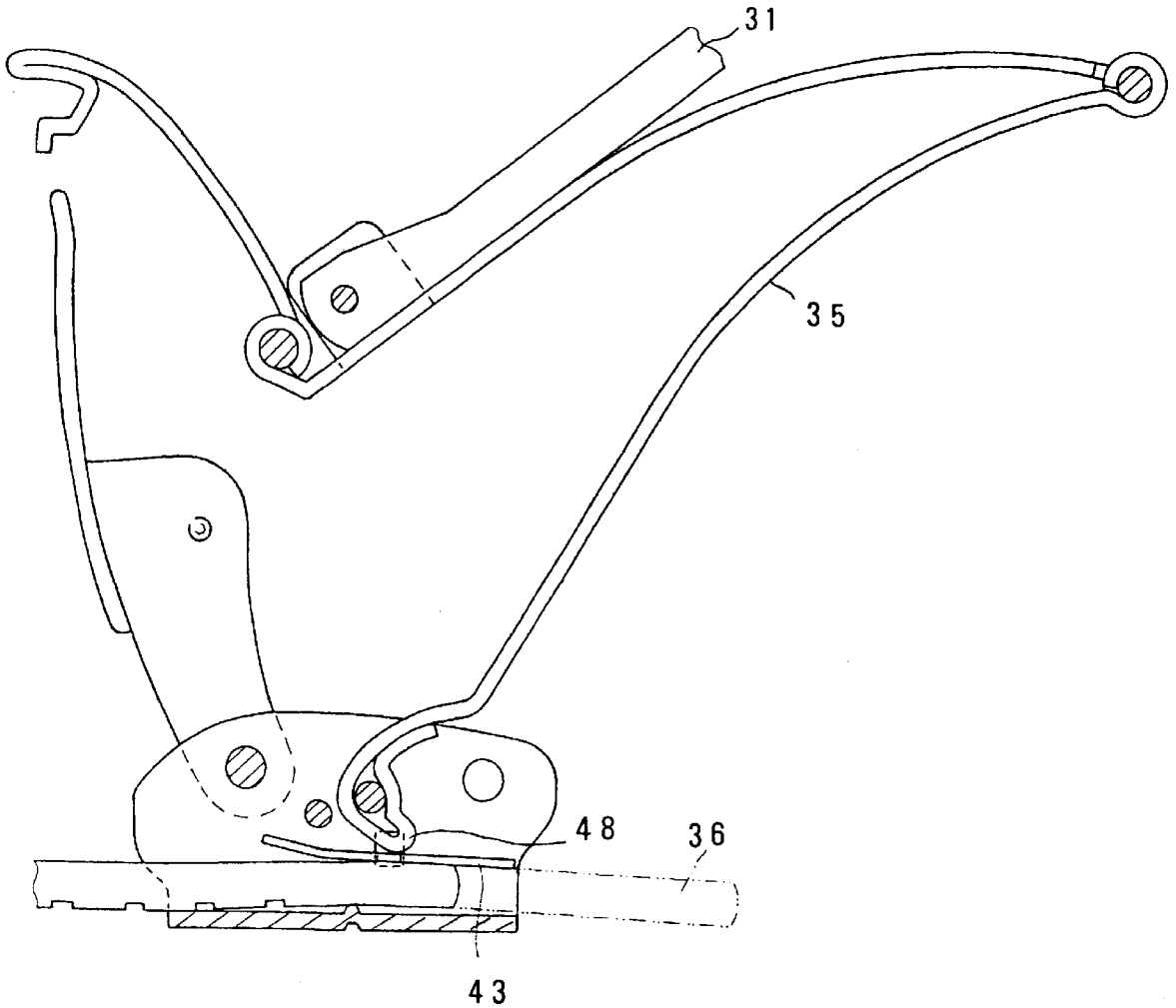
FIG. 4 is a sectional view explaining opening and closing operations.
Figure 5:
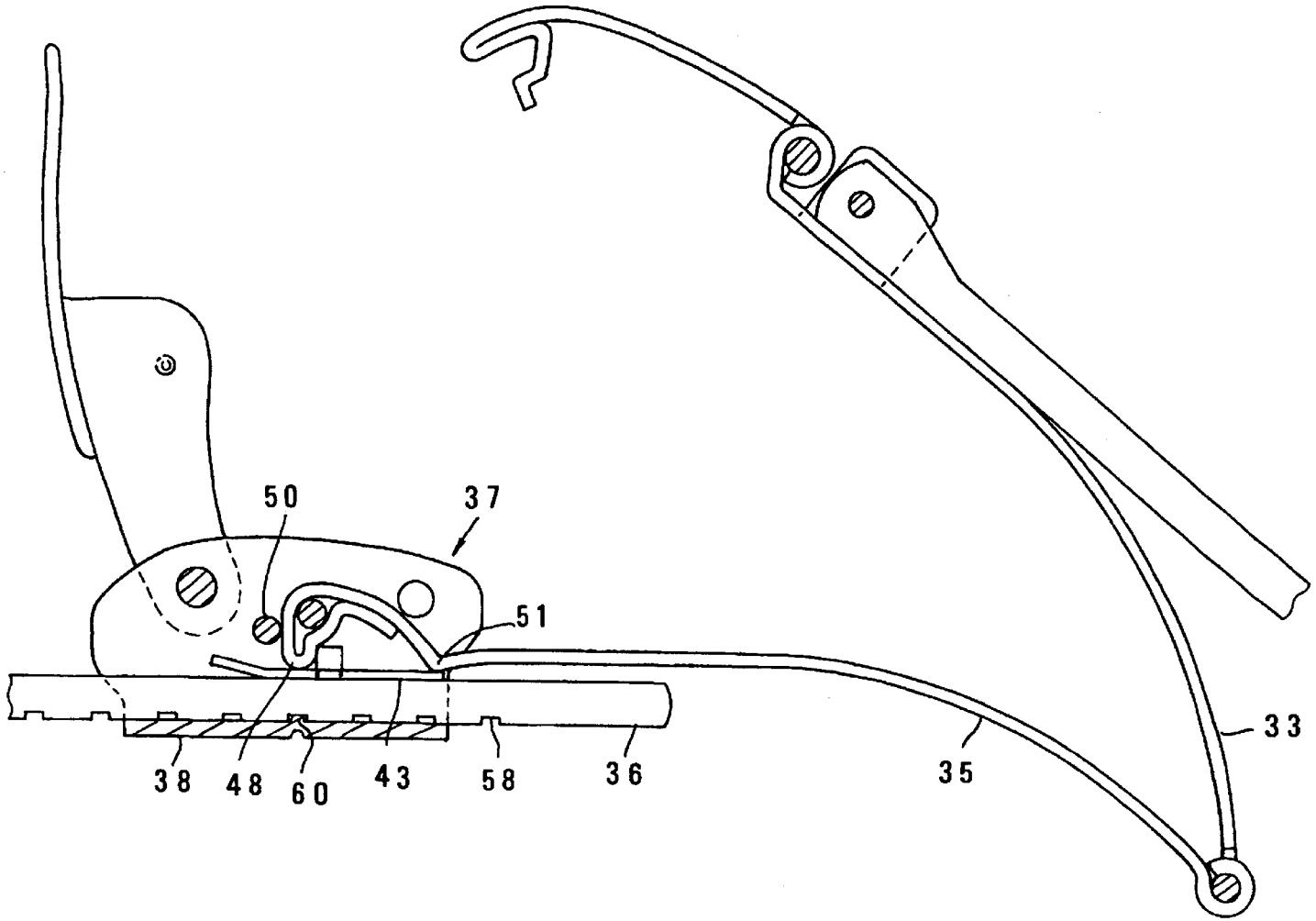
FIG. 5 is a sectional view explaining the opening and closing operations.
Figure 6:
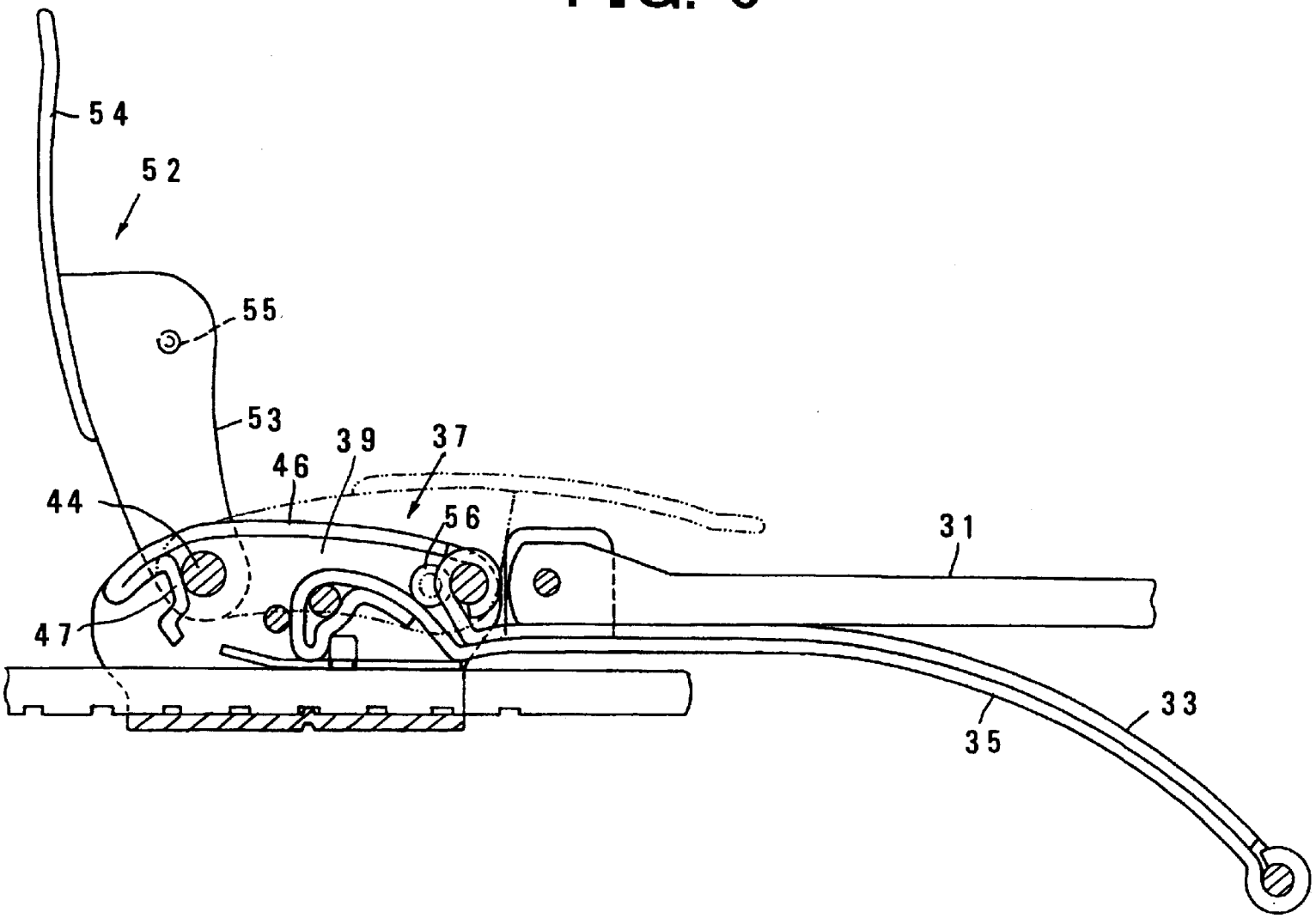
FIG. 6 is a sectional view explaining the opening and closing operations.
Figure 7:
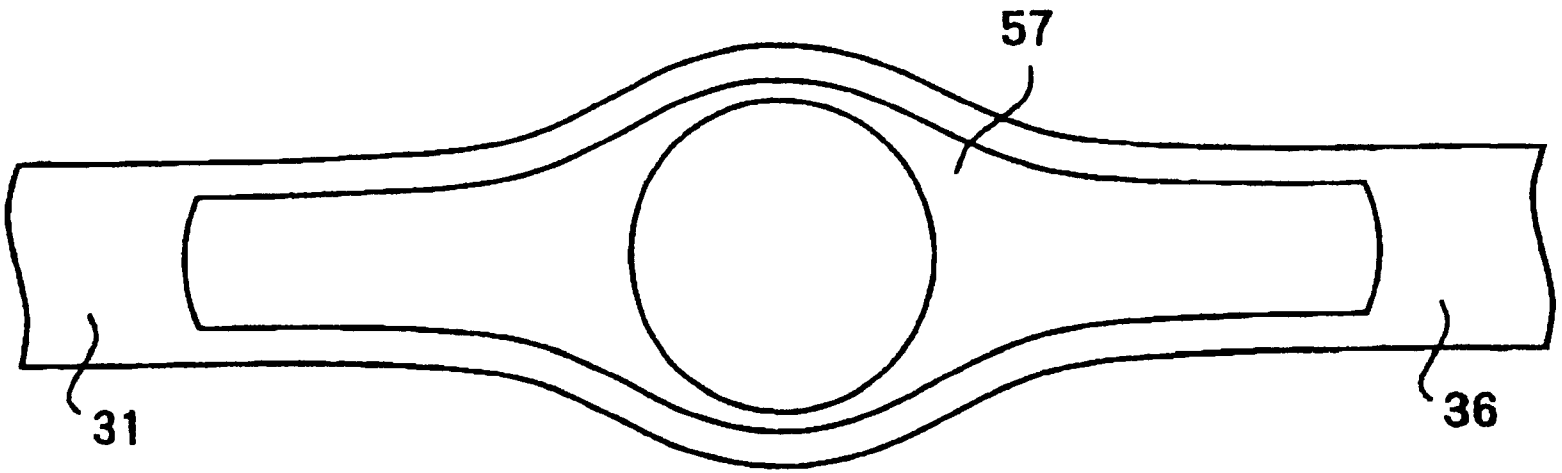
FIG. 7 is a plan view showing a band.

FIG. 1 is a perspective view showing a first embodiment of the present invention, FIG. 2 is an enlarged perspective view of FIG. 1, FIG. 3 is a plan view, FIGS. 4 to 6 are sectional views describing opening and closing operations, and FIG. 7 is a plan view showing a band.

The first embodiment of the present invention will be described with reference to FIGS. 1 to 5.

The buckle according to the present invention comprises an upper plate 33 rotatably connected to an end of a first band 31 by a pin 32 at an end, an lower plate 35 connected to the other end of the upper plate 33 by a pin 34 at an end, and a band lock mechanism 37 connected to the other end of the lower plate by a pin, in which mechanism 37 a second band 36 is inserted.

The band lock mechanism 37 has a slidable frame 40 comprising a bottom plate 38 and a pair of side walls 39 extending from both sides of the bottom plate, and a push plate 43 having a pair of supporting lugs 42 each of which is inserted in an elongated hole 41 formed in the side wall 39 with a slight play in the vertical direction. The push plate 43 is adapted to lightly abut on the band 36 so that the slidable frame 40 may slide along the band.

An end of the push plate 43 is slightly bent upward so as to facilitate the insertion of the band 36. The band lock mechanism 37 further has a cover 46 pivotally connected to the end of the upper plate 33 by a pin 45. The upper and lower plates 33 and 35 are folded and an engaging hook 47 projecting from the cover 46 is engaged with an pin 44 which will be described later in detail. Thus the diameter of the band can be decreased so as to be worn on the wrist. In addition, the end of the lower plate 35 is bent downward to form a V shape in cross section, thereby forming a pushing projection 48 for depressing the push plate toward the second band 36.

In accordance with the first embodiment of the present invention, a stopper rod 50 is fixed between the side walls 39 at a position outer side of the pushing projection 48. As shown in FIG. 5, in a buckle fixing position where the push projection 48 is substantially perpendicular to the push plate 43 thereby depressing the push plate most forcibly, the outer wall of the pushing projection 48 abuts against the stopper rod 50 so that the lower plate 35 cannot be further rotated.

The lower plate 35 is bent toward the second band 36 to form a shape of an L at a position adjacent the pushing projection 48, thereby forming a pushing ridge 51, which, at the band fixing position shown in FIG. 5, depresses the push plate 43.

A lock frame 52 is rotatably mounted on the pin 44. The lock frame 52 comprises a pair of side plates 53 and an upper plate 54. A lock projection 55 is inwardly projected from each of the side plates 53 so as to be engaged with a hole 56 formed in each of the side walls 39 of the buckle. The upper plate 54 presses the cover 46 thereby preventing the cover to rise upward.

The bands 31 and 36 are made of plastic, and has a stainless curved plate 57 embedded therein as shown in FIG. 7. The curved plate 57 is curved to form a shape of a C at a curvature larger than the outer peripheral curvature of a wrist in general, and can be yielded in a direction to open the band.

On the other hand, on the underside of the band, a plurality of grooves 58 are formed at a predetermined interval in a lateral direction of the band. A rib 60 formed on the underside of the bottom plate 38 of the lock mechanism 37 is engaged with one of the grooves as shown in FIG. 5.

The operation for adjusting the band will now be described.

Referring to FIG. 4, when the lower plate 35 of the buckle is rotated so as to depart from the band 36, the pushing projection 48 is disengaged from the push plate 43 to release the plate, enabling to move the lock mechanism 37 along the band 3. Hence, the lock mechanism 37 is positioned in accordance with the size of the wrist and the lower plate 35 is rotated toward the second band 36. At a position shown in FIG. 5, the pushing projection 48 depresses the push plate 43, thereby abutting the push plate against the band 36, so that the lock mechanism 37 is attached to the second band 36.

Thereafter, the pushing ridge 51 of the lower plate 35 forces the push plate 43 to depress the second band 36, thereby ensuring the fixing of the buckle. At the time, the rib 60 on the bottom plate 38 engages with one of the grooves 58 of the second band 36, thereby further rendering the buckle immovable. Thus, the length of the band is adjusted in accordance with the diameter of the wrist of the wearer. In order to change the band length, the above-described operation is carried out in the reverse order.

The operation for wearing the band is described hereinafter. The upper plate 33 is further rotated to the right from the position shown in FIG. 5 so that the diameter of the band is increased. Next, the upper plate 33 is folded over the lower plate 35 as shown in FIG. 6. The cover 46 is rotated so that the engaging hook 47 engages with the pin 44, and the buckle is mounted on the wrist. Thereafter, the lock frame 52 is rotated toward the buckle 37 as shown by the dash-dot line in FIG. 6, so that the lock projections 55 are engaged in the holes 56 of the side walls 39 of the buckle. Thus the buckle is locked. The reverse operation is carried out when taking off the band.

As described above, the curved plate 57 is embedded in the band so as to urge the band in the opening direction. Thus, in order to adjust the length of the band, when the lower plate 35 is raised, the pushing projection 48 is released from the push plate 43. In that state, each of the parts substantially maintains the position shown in FIG. 4, and the second band 36 pushes the push plate 43 upward, thereby to abut the plate 43 against the pushing projection 48. On the other hand, the first band 31 holds the pushing projection 48 downward, depressing the push plate 43. As a result, the push plate 43 of the buckle 37 abuts on the second band 36, thereby preventing the buckle from falling off from the band. Accordingly, the length of the band can be easily adjusted while the watch is worn on the wrist.

At the end of the first band 31 and the end of the second band, a personal adornment such as a watch (not shown) is attached with a connecting member such as a spring-loaded pin and pin inserted in legs of the watch.

Figure 8:
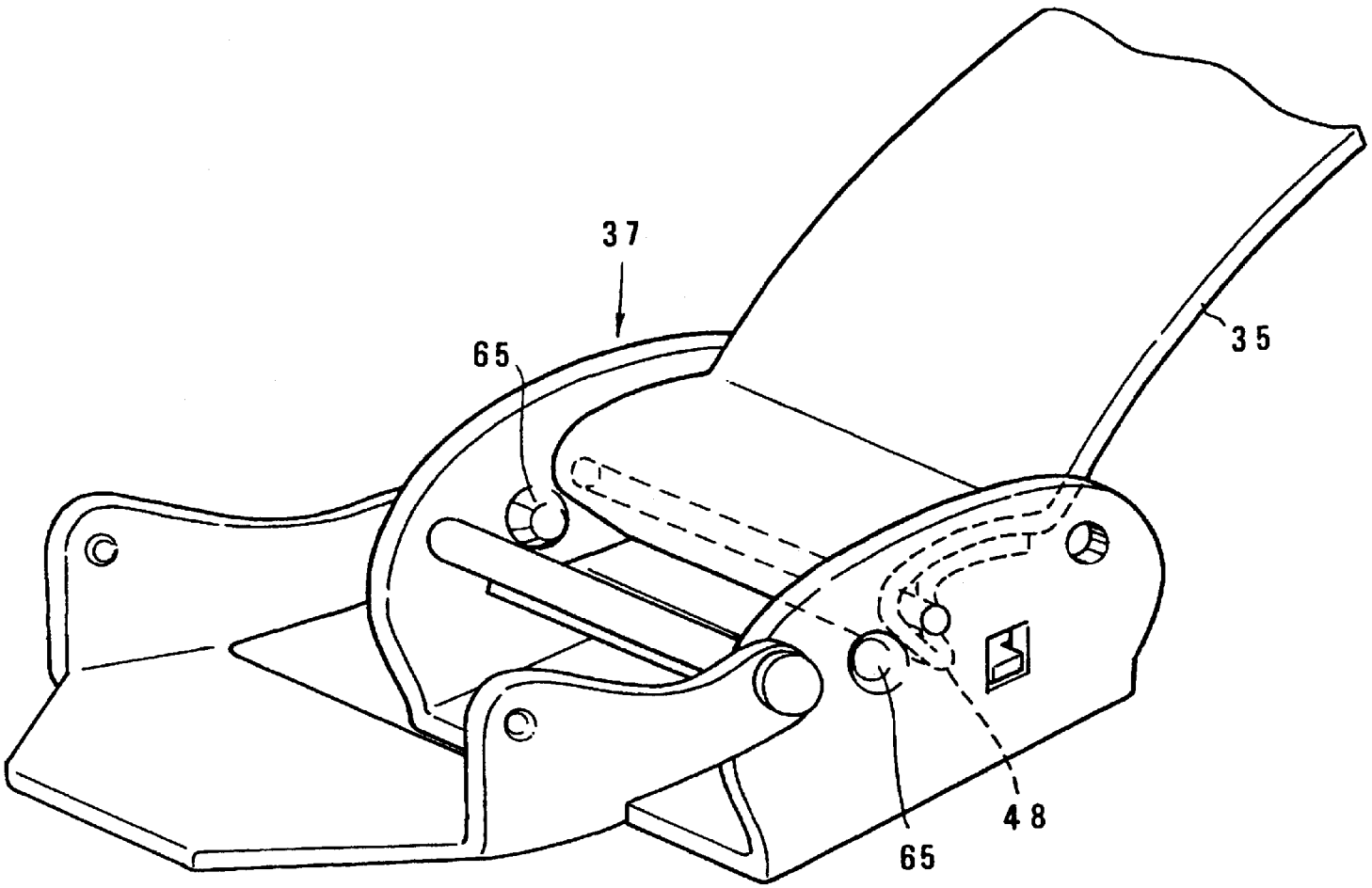
FIG. 8 is a perspective view showing a second embodiment of the present invention.

FIG. 8 is a perspective view showing the second embodiment of the present invention. In the embodiment, instead of the stopper rod 50 of the previous embodiment, there is formed a pair of stopper lugs 65 inwardly projecting from the side walls of the band lock mechanism 37. Other constructions are the same as those of the first embodiment, the same parts are identified by the same reference, and the operation is the same.

The production is facilitated and the number of parts is decreased in the present embodiment.

Figure 9:
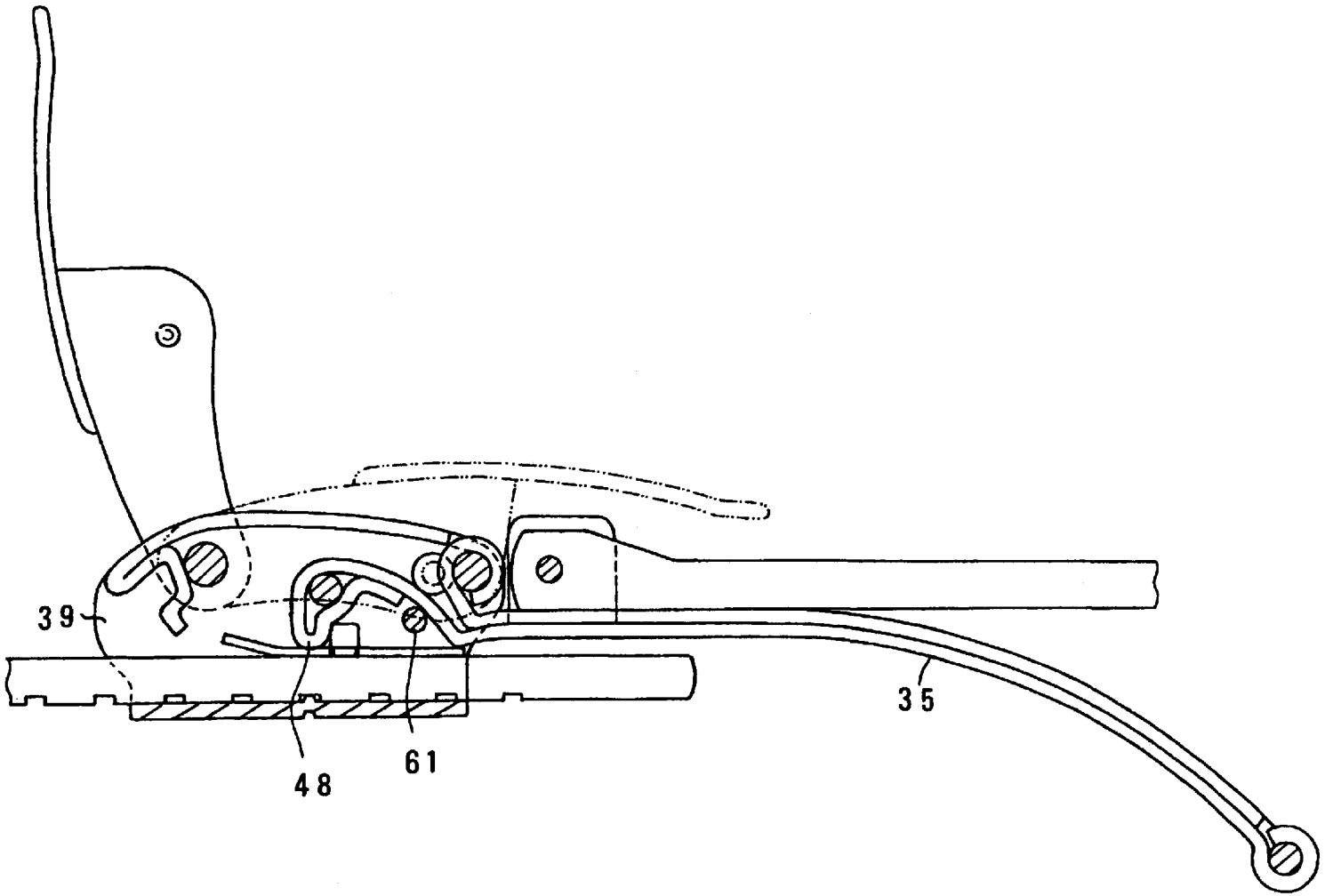
FIG. 9 is a sectional view of a third embodiment of the present invention.

FIG. 9 is a sectional view of the third embodiment. In the present embodiment, a stopper rod 61 is provided at an inner position of the pushing projection 48, fixed between the side walls 39. The stopper shaft 61 disposed at a such a position can prevent the excessive rotation of the pushing projection as in the embodiments hereinbefore described.

Figure 10:
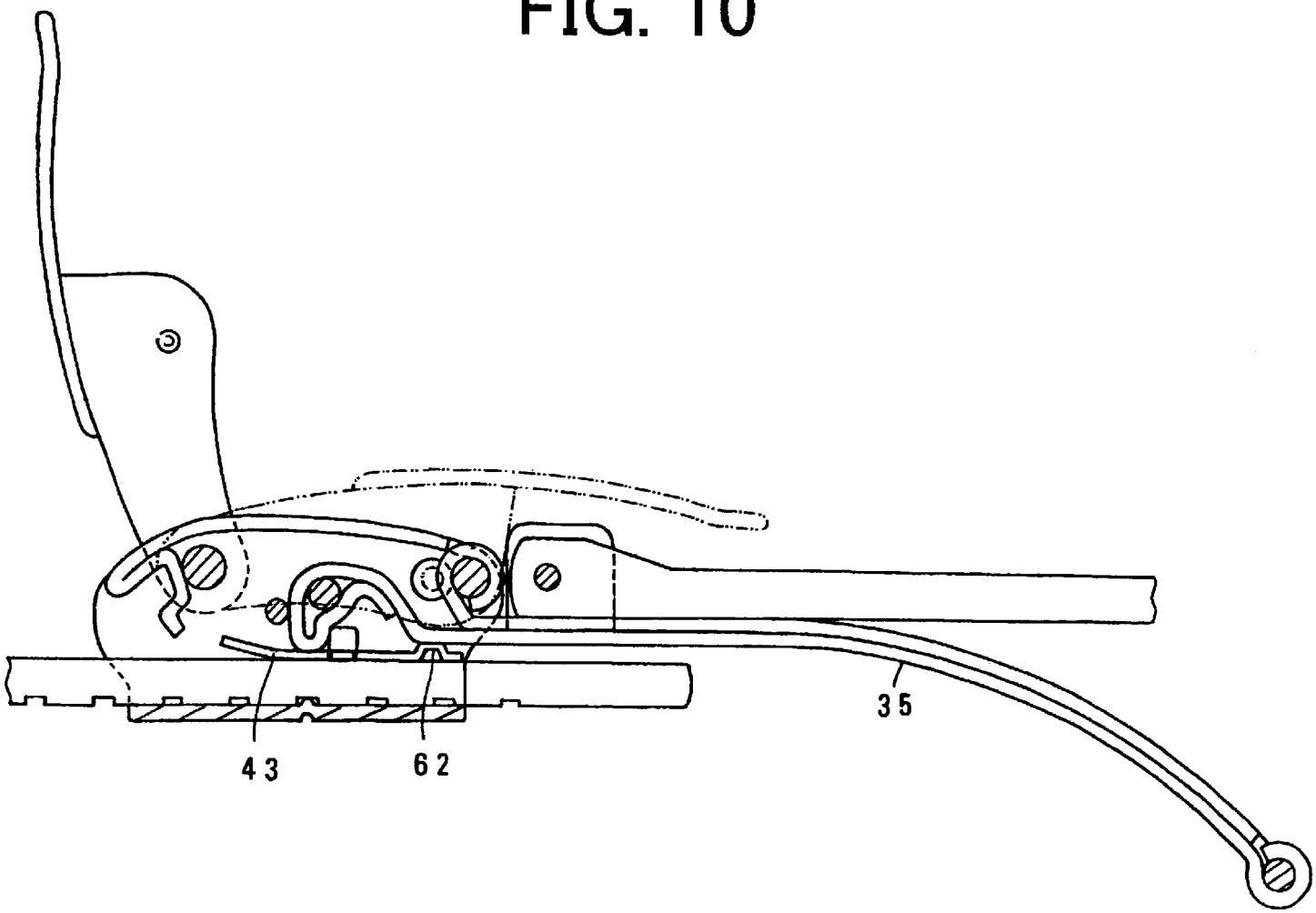
FIG. 10 is a sectional view of a fourth embodiment of the present invention.

FIG. 10 is a sectional view of the fourth embodiment. Although the base of the lower plate 35 is bent into the L shape in the hereinbefore described embodiments so as to depress the lower plate against the push plate 43, in the present embodiment, a projection rib 62 is formed on the push plate 43 to be depressed against the lower plate is formed on the push plate 43.

Figure 11:
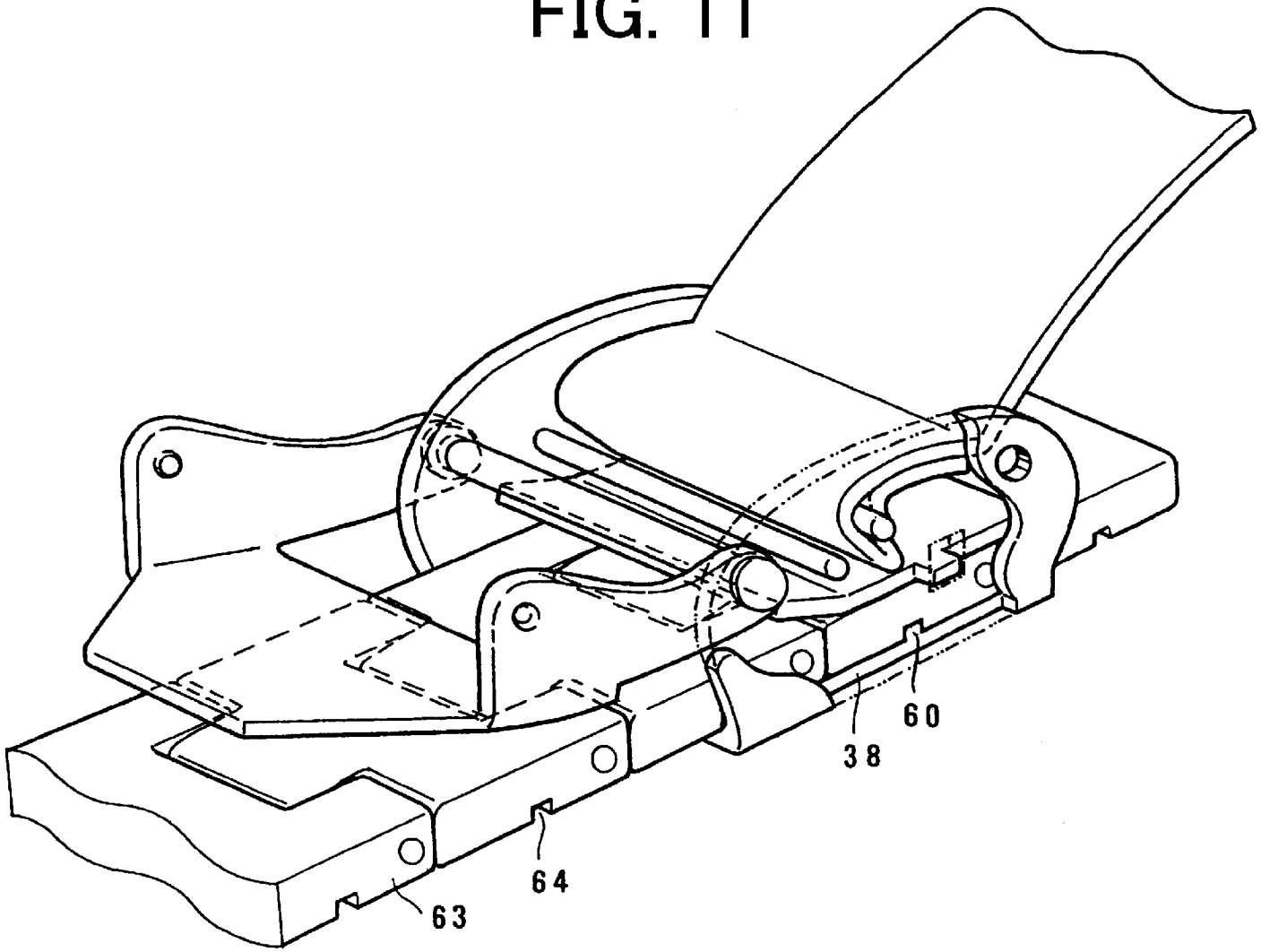
FIG. 11 is a perspective view of a fifth embodiment of the present invention.

FIG. 11 is a perspective view showing the fifth embodiment. In the embodiment, a metal band 63 is substituted for the plastic band of the first embodiment. On the underside of each link composing the band, a lateral groove 64 is formed. The rib 60 of the bottom plate 38 of the buckle is adapted to be engaged with one of the grooves 64. Other constructions are the same as that of the first embodiment.

Each of the above-described embodiments are an example wherein the present invention is applied to the double-fold buckle comprising two connecting plates. The present invention may be applied to a triple-fold buckle comprising three connecting plates.

As described above, in the present invention, since the lock frame 52 is provided, the connecting plate is prevented to be released upward. Since the downward rotation of the connecting plate is restricted, the personal adornment band does not fall off.

Figure 12:
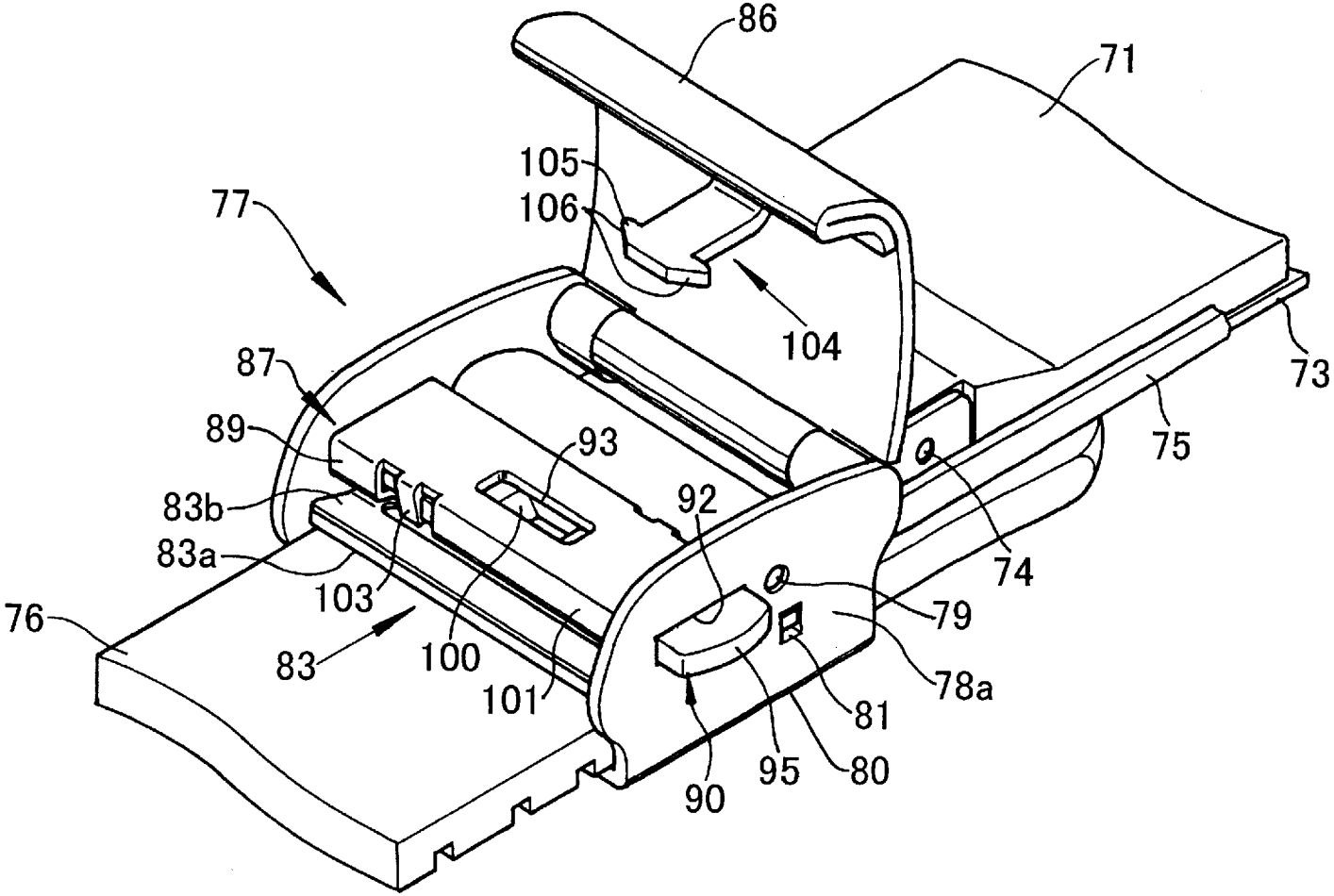
FIG. 12 is a perspective view of a sixth embodiment of the present invention.
Figure 13:
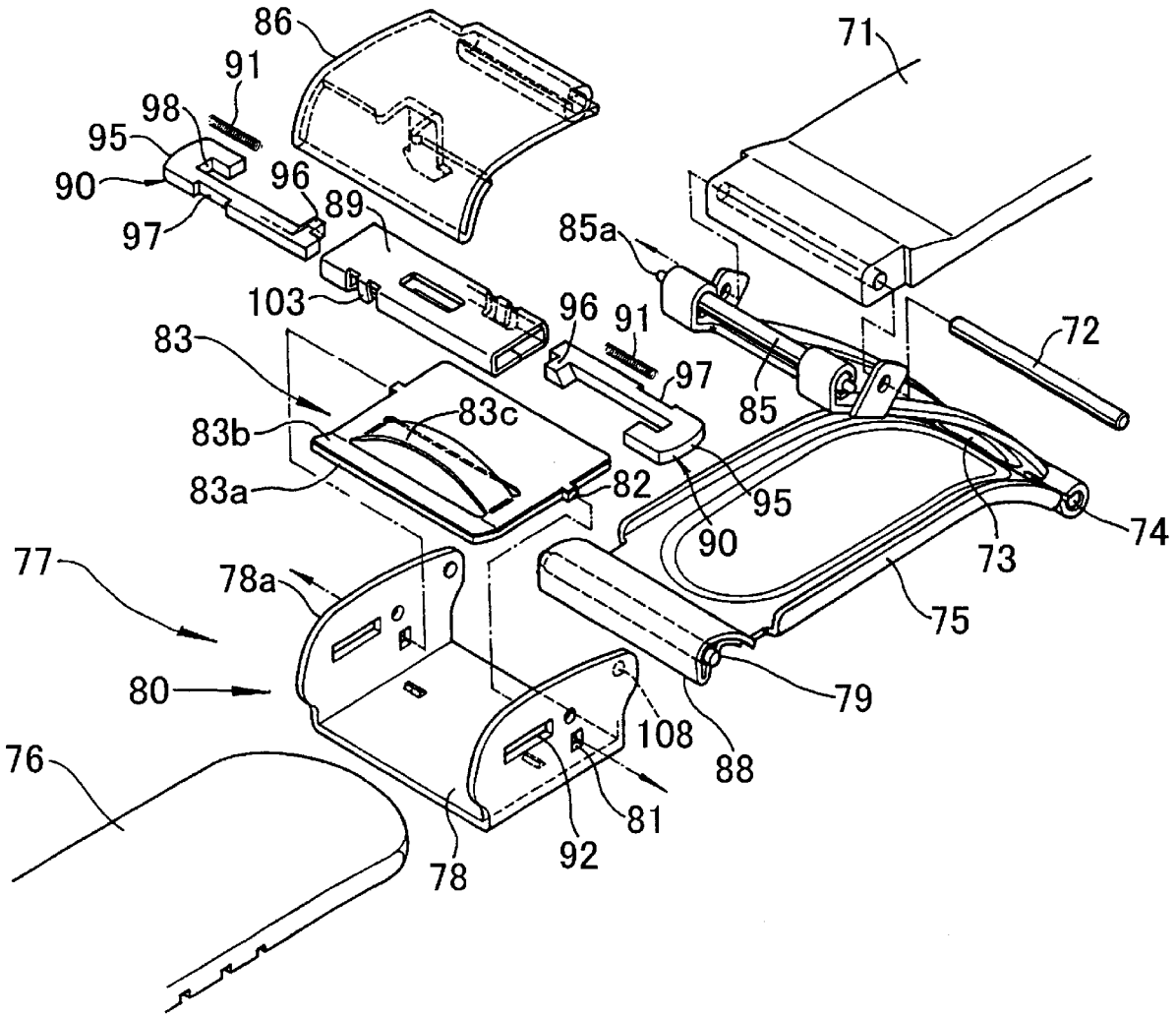
FIG. 13 is an exploded perspective view of the sixth embodiment.

FIG. 12 is a perspective view of the sixth embodiment and FIG. 13 is an exploded perspective view thereof.

The buckle of the present embodiment comprises an upper plate 73 rotatably connected to an end of the first band 71 by a pin 72, a lower plate 75 connected to the other end of the upper plate 73 by a pin 74, and a band lock mechanism 77 connected to the other end of the lower plate 75 by a pin 79 and in which a second band 76 is inserted.

The band lock mechanism 77 has a slidable frame 80 comprising a bottom plate 78 and a pair of side walls **78*a* extending from both sides of the bottom plate, and a push plate 83. The push plate 83 comprises an abutting plate 83*a* and a spring plate 83*b* which have the same contour in plan view. Each of the plates 83*a* and 83*b* is provided with a pair of lugs 82 which are inserted in a pair of elongated holes 81 formed in the side walls 78*a*. A pair of slits are formed in the spring plate 83***b* so as to cut out an upwardly curved spring portion 83*c*. The push plate 83 is adapted to lightly abut on the band 76 so that the slidable frame 80 may slide along the band inserted therein. An end of the push plate 83 is slightly bent upward so as to facilitate the insertion of the band 76.

The lock mechanism 77 further has a cover 86 pivotally connected to an end of the upper plate 73 by a spring-loaded pin 85, and a lock device 87. The other end of the lower plate 75 is bent downward to form a V shape, thereby forming a pushing projection 88 for depressing the push plate 83 to the second band 76.

The lock device 87 comprises a guide housing 89 in which a pair of push buttons 90 and a pair of springs 91 for urging the push buttons are disposed. The guide housing 89 has a box-like shape, rectangular in section, and fixed to the side walls 78*a* with the ends thereof opened to confront a pair of openings 92 formed in the side walls. Holes 93 and 94 (FIGS. 15*a*, 15*b*) are formed on the upper and lower plates of the guide housing 89, respectively.

As shown in 14*a*, push buttons 90 are disposed in point symmetry so as to be slidable in the lateral direction of the band. The springs 91 are disposed between the push buttons 90.

Each push button 90 has a manipulating portion 95 which projects out of the opening 92 in the side wall 78*a* and urged outward by the spring 91.

As shown in FIG. 13, the push button 90 has an engaging lug 96 formed at one of the sides at an inner end portion, a guide recess 97 on the outer surface, and a recess 98 at an inner end for housing the spring 91. The engaging lug 96 has an inclined guide surface 100 (FIG. 15*a*) which inclines in the lateral direction of the band. The engaging lugs 96 oppose each other in the lateral direction of the band and are positioned within the holes 93, 94 of the guide housing 89.

Thus, the spring portion 83*c* is concealed by the guide housing 89 so as not to be apparent from the outside. Each of the springs 91 is disposed in a space between the recess 98 of one of the push buttons 90 and the engaging lug 96 of the other push button 90.

Figure 14A:
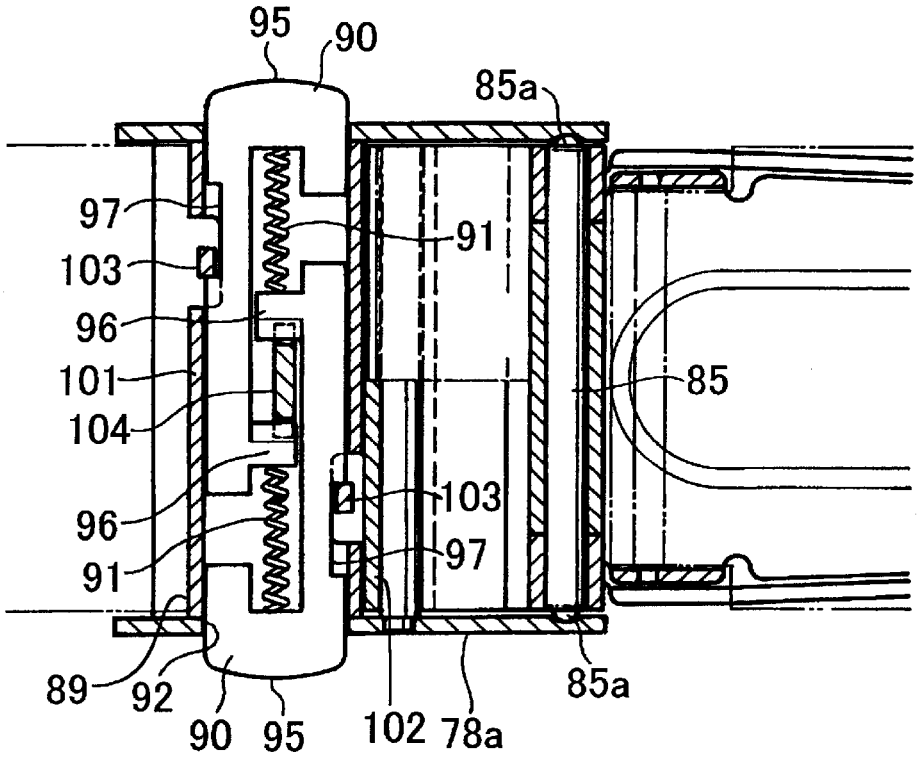
FIG. 14*a* is a sectional plan view of the sixth embodiment.

A pair of stopper lugs 103 are formed in point symmetry on lateral side walls 101 and 102 with respect to the band as shown in FIG. 14*a*. Each lug 103 is inserted in the guide recess 97 of the push button 90, thereby to restrict the stroke of the push button, and further to prevent the push button from falling out.

Figure 16:
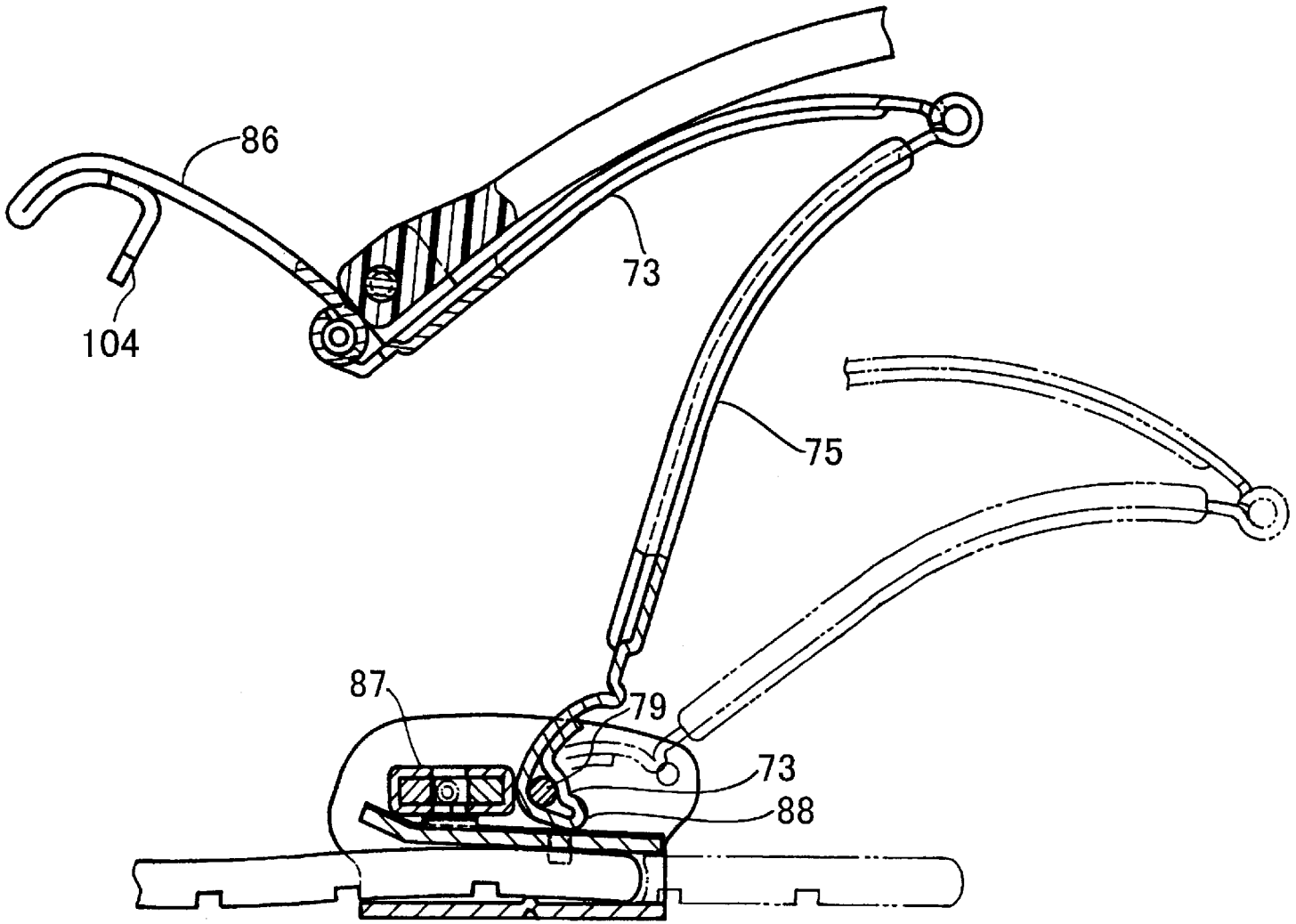
FIG. 16 is a side view showing various members in released state.
Figure 17:
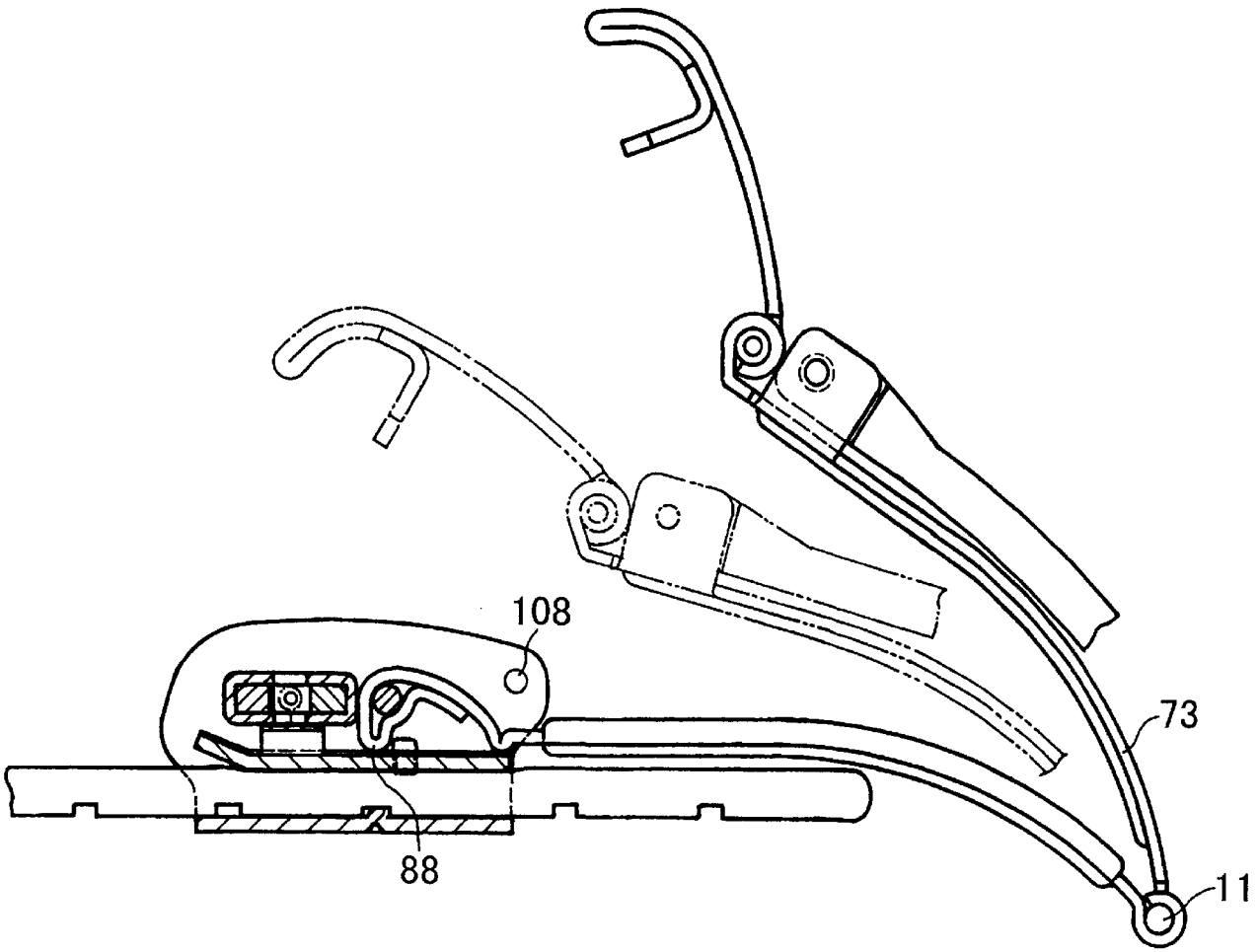
FIG. 17 is a side view showing a fixed band.

Although the lower plate 75 is rotatable about the pin 79 as shown in FIG. 16, in the embodiment, when the buckle is closed as shown in FIG. 17, the side surface of the pushing projection 88 abuts against the housing 89, so that the further rotation is prevented.

As shown in FIG. 12, a T-shaped hook 104 projects from the underside of the cover 86. At the tip end of the hook 104, there is formed a engaging portion 105 which projects in the lateral direction of the band, and at the end of the engaging portion 105, a pair of inclined surfaces 106 are formed so as to render the width of the engaging portion 105 to be decreased toward the ends.

The method of using the buckle of the present embodiment will be described.

The method for fixing the band 76 to the buckle is the same as in the first embodiment so that the description thereof is omitted.

When the lower plate 75 is at a stop position, the pushing projection 88 is disposed so as to be substantially perpendicular to the surface of the push plate 83, thereby depressing the push plate 83 with the maximum force. Hence the slidable frame 80 is securely fixed to the band 76.

Since the lower plate 75 cannot be rotated in the clockwise direction in FIG. 17, the band 76 is prevented from being released and disengaged from the slidable frame 80 due to a further rotation of the lower plate 75.

In addition, since the pushing projection 88 is adapted to abut on the guide housing 89, an additional machining is not needed.

Next, as shown in FIG. 17, the upper plate 73 is rotated in the counterclockwise direction so that the inner walls of the side walls 78*a* of the slidable frame 80 depress a pair of shafts 85*a* of the spring-loaded pin 85 to be retracted within the pin 85. When each shaft 85*a* reach a blind hole 108 formed in the side walls, due to the urging of the spring provided in the pin 85, the shaft 85*a* projects out into the hole 108 to be engaged.

Since the spring-loaded pin 85 which is a connecting shaft is thus resiliently engaged in the slidable frame 80, the plates 73 and 75 can be engaged in the slidable frame 80 with a small number of parts.

The locking and releasing operations of the lock device 87 are described hereinafter.

Figure 15A:
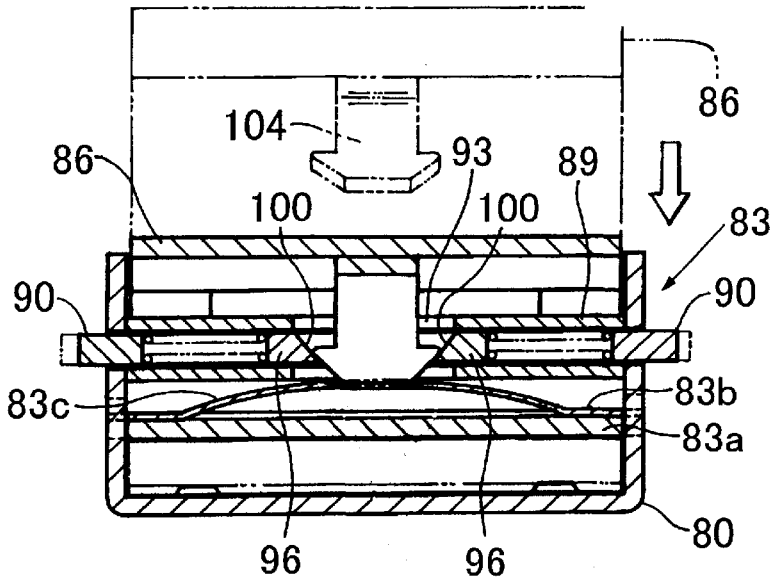
FIG. 15*a* is a sectional view showing a locked state.
Figure 15B:
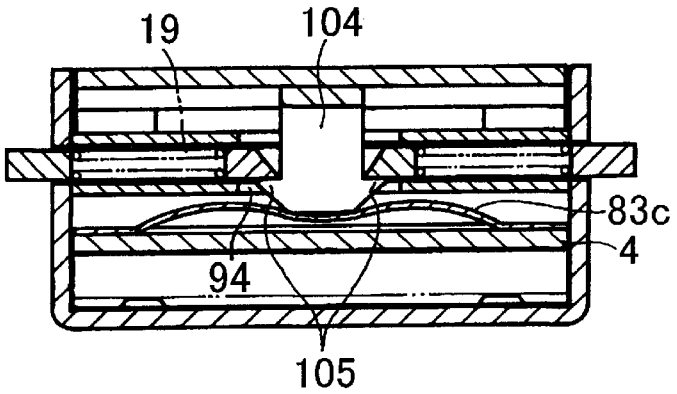
FIG. 15*b* is a sectional view showing a lock member in fixed state.
Figure 18:
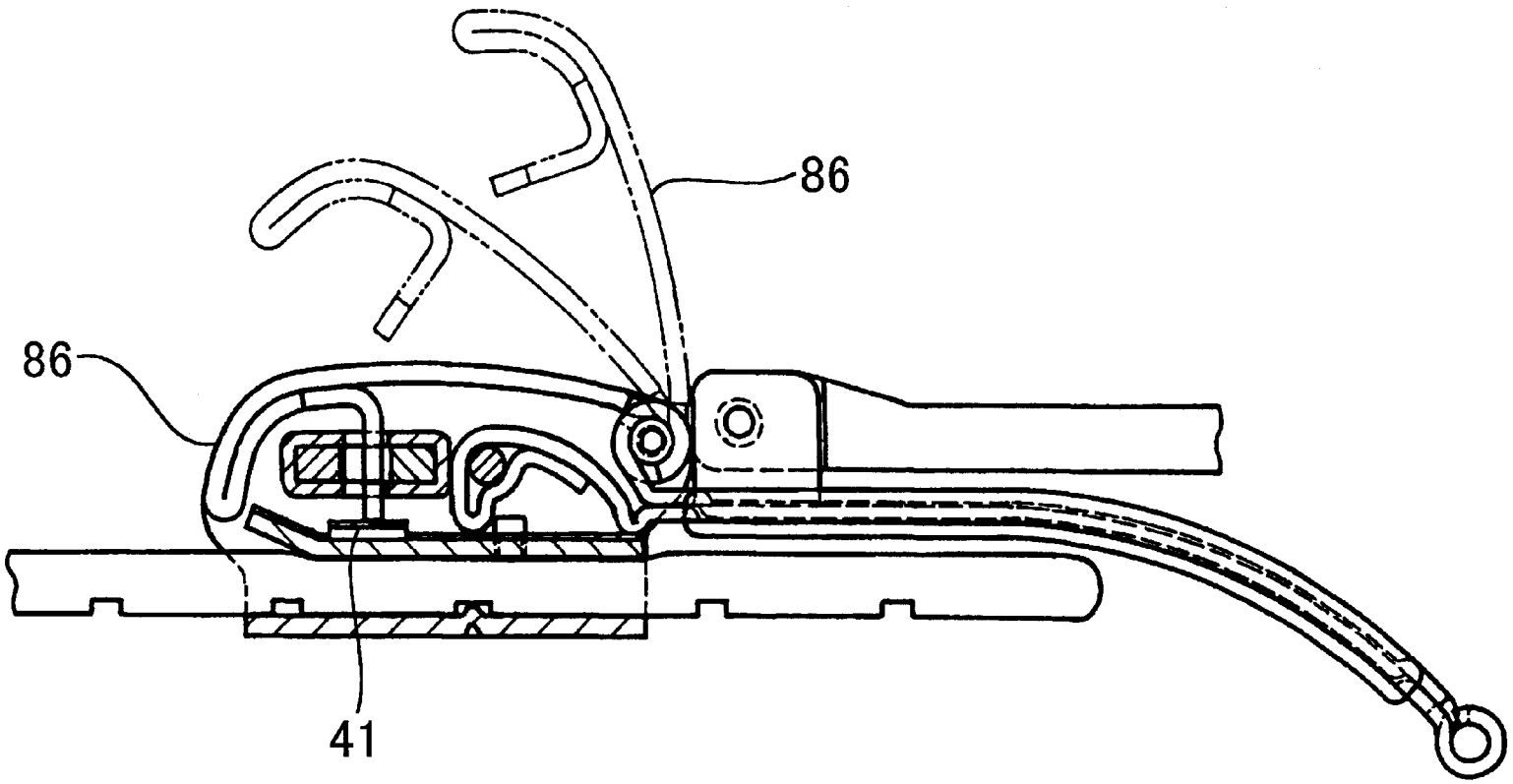
FIG. 18 is a side view showing a locked state.

When the cover 86 is rotated in the counterclockwise direction as shown in FIG. 18, the hook 104 is inserted in the hole 93 of the guide housing 89 as shown in FIG. 15*a*, so that each of the inclined surfaces 106 thereof abuts against the inclined guide surface 100, thereby pushing the engaging lug 96 outward. When the cover 86 is further rotated, the hook 104 passes the inclined surfaces 100 so as to project from the hole 94. As shown in FIG. 15*b*, the push button 90 is returned by the spring 91 so that the engaging portion 105 of the hook 104 engages the underside of the engaging lug 96, thereby locking the buckle.

When the buckle is thus locked, the hook 104 depresses the spring portion 83*c* of the push plate 83 to yield as shown in FIG. 15*b*. Therefore, the abutment of the hook 104 to the push button 90 is maintained.

In addition, the hook 104 depresses the push plate 83 through the spring portion 83*c* so that the slidable frame 80 is pressed against the band 76. Thus the band 76 is securely held in the slidable frame 80.

Figure 14B:
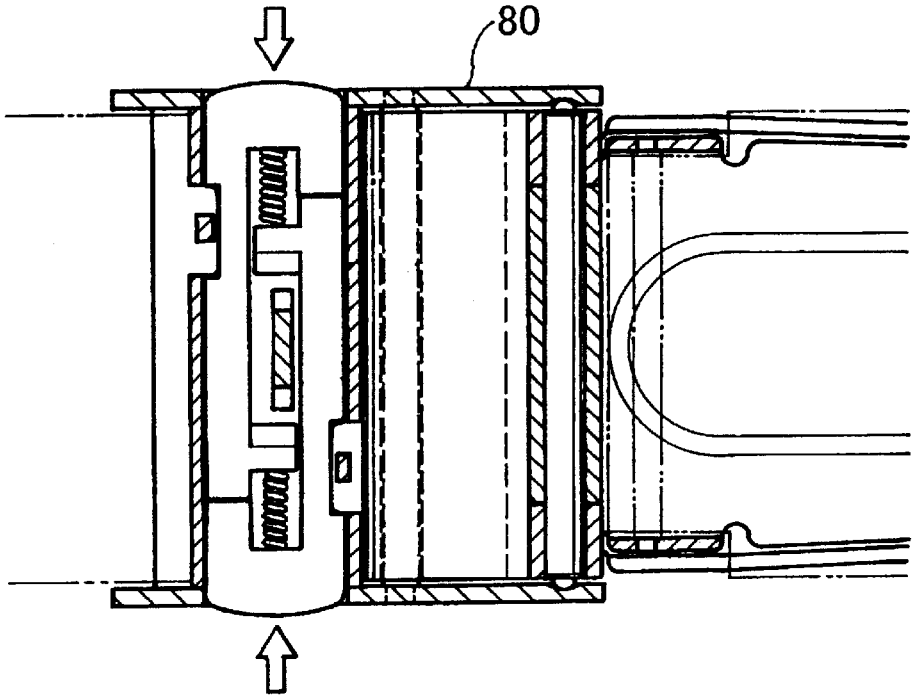
FIG. 14*b* is a sectional plan view of a depressed push button.
Figure 15C:
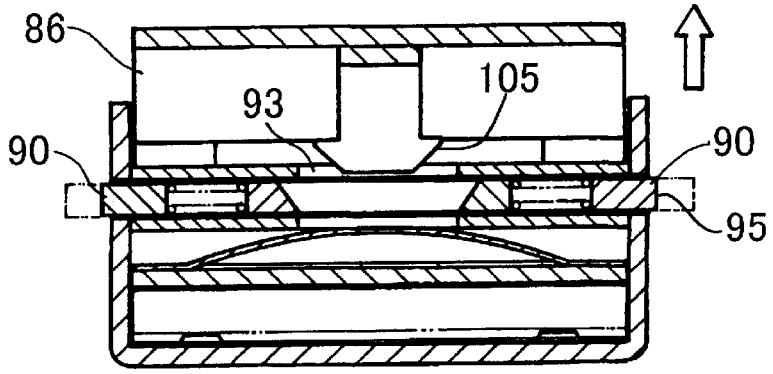
FIG. 15*c* is a sectional view showing a released state.

In order to release the lock device 87, as shown in FIGS. 14*b* and 15*c*, the manipulating portions 95 of the push button 90 are held between the thumb and the forefinger and depressed against the urging of the spring 91. The engaging lugs 96 are accordingly disengaged from the engaging portion 105 of the hook 104. Due to the resilience of the yielded spring portion 83*c*, the hook is raised so as to be discharged from the hole 93, thereby automatically opening the cover 86. Thus the lock device is released.

The seventh embodiment of the present invention will now be described with reference to FIGS. 19 to 21. The cover, upper plate and the lower plate of the present embodiment are the same as those of the sixth embodiment. Therefore, the same parts are designated by the same numerals and the descriptions thereof are omitted.

The buckle comprises the cover 86, a slidable frame 150, guide housing 151, push plate 152, and a pair of springs 154 disposed in the guide housing 151. The construction and the operation of the push button and the springs 154 are the same as those of the sixth embodiment, and the descriptions thereof are omitted.

The push plate 152 comprises a spring plate 155 and an abutting plate 156, each having lugs 157 and 158, respectively, at the front portion. The lugs 157 and 158 engage with vertically elongated holes 161 which are formed in side walls of the slidable frame 150.

The spring plate 155 has at one side thereof, a spring portion 162 extended from one end thereof to form a free end. The spring portion is upwardly arcuated as in the previous embodiment.

Figure 19:
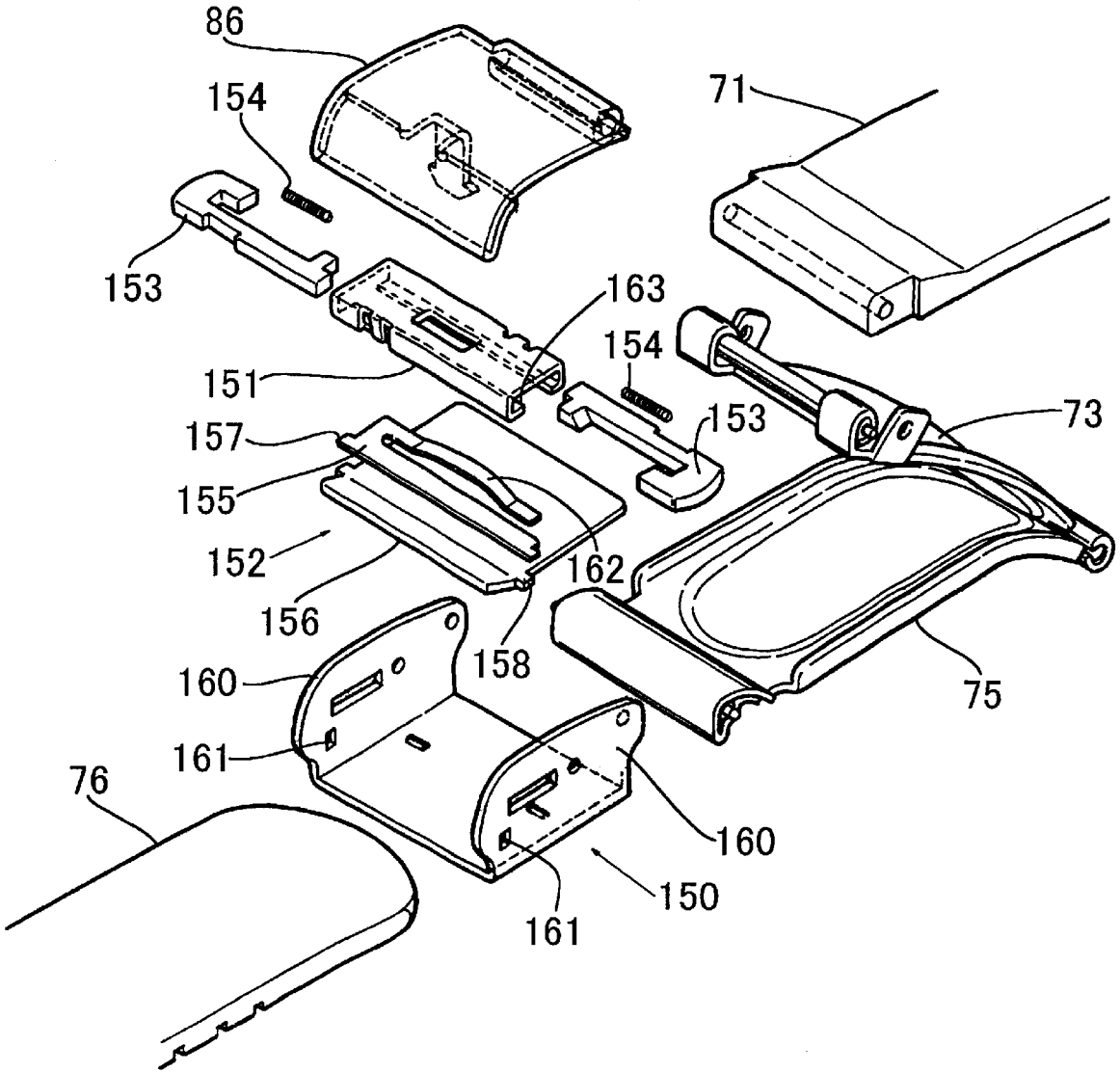
FIG. 19 is an exploded perspective view of a seventh embodiment of the present invention.
Figure 20:
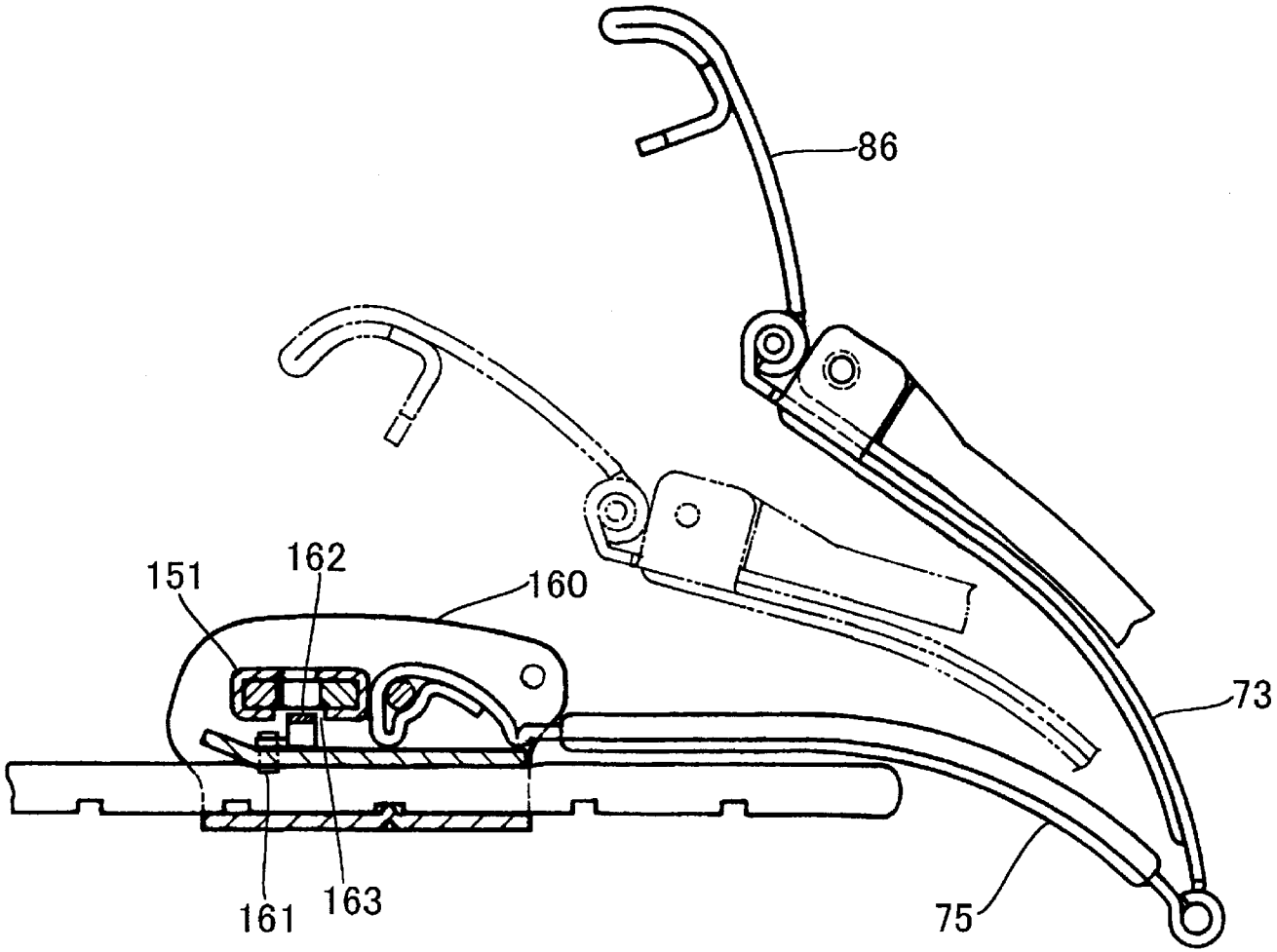
FIG. 20 is a side view.
Figure 21:
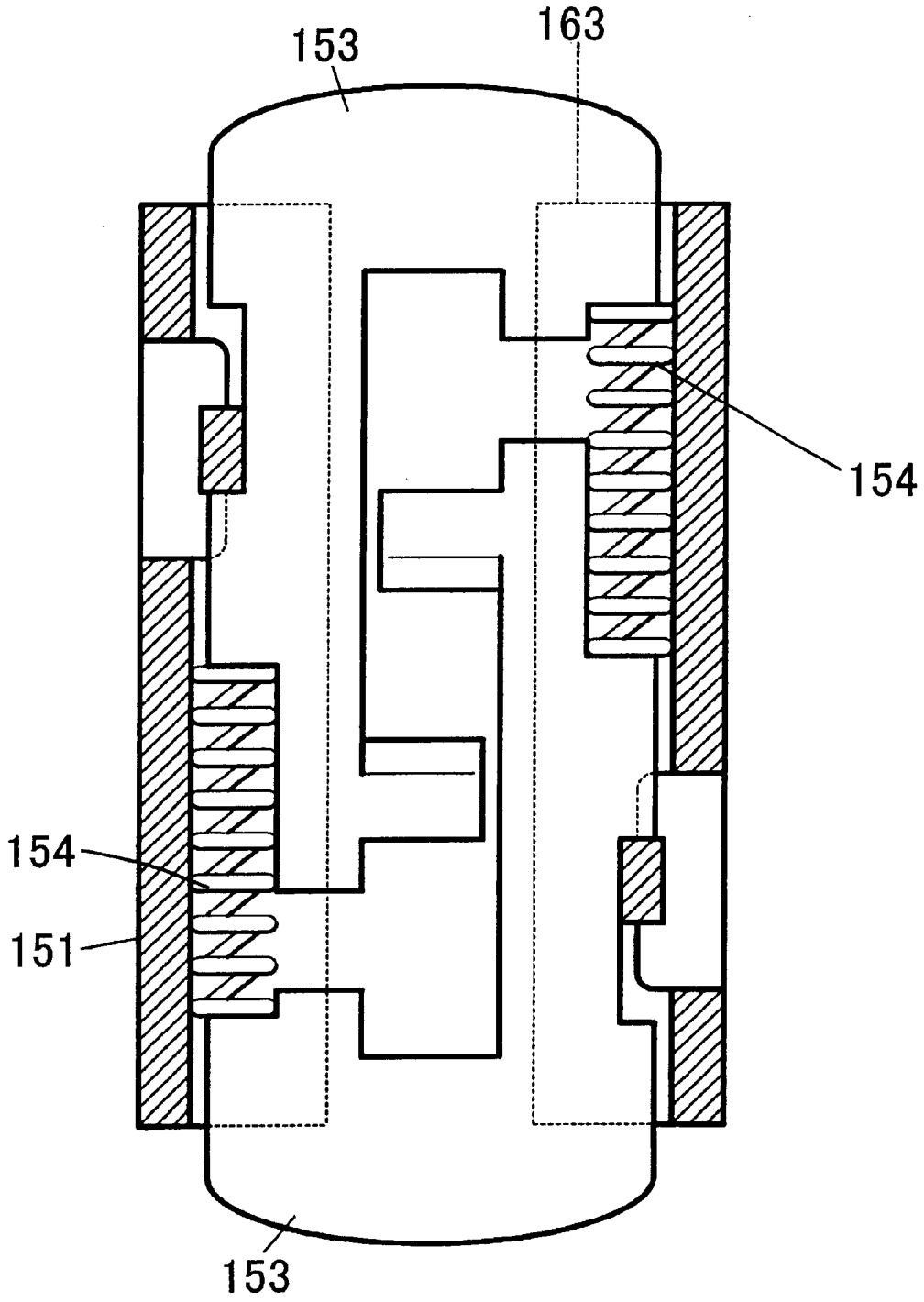
FIG. 21 is a sectional plan view of a guide housing.
Figure 22:
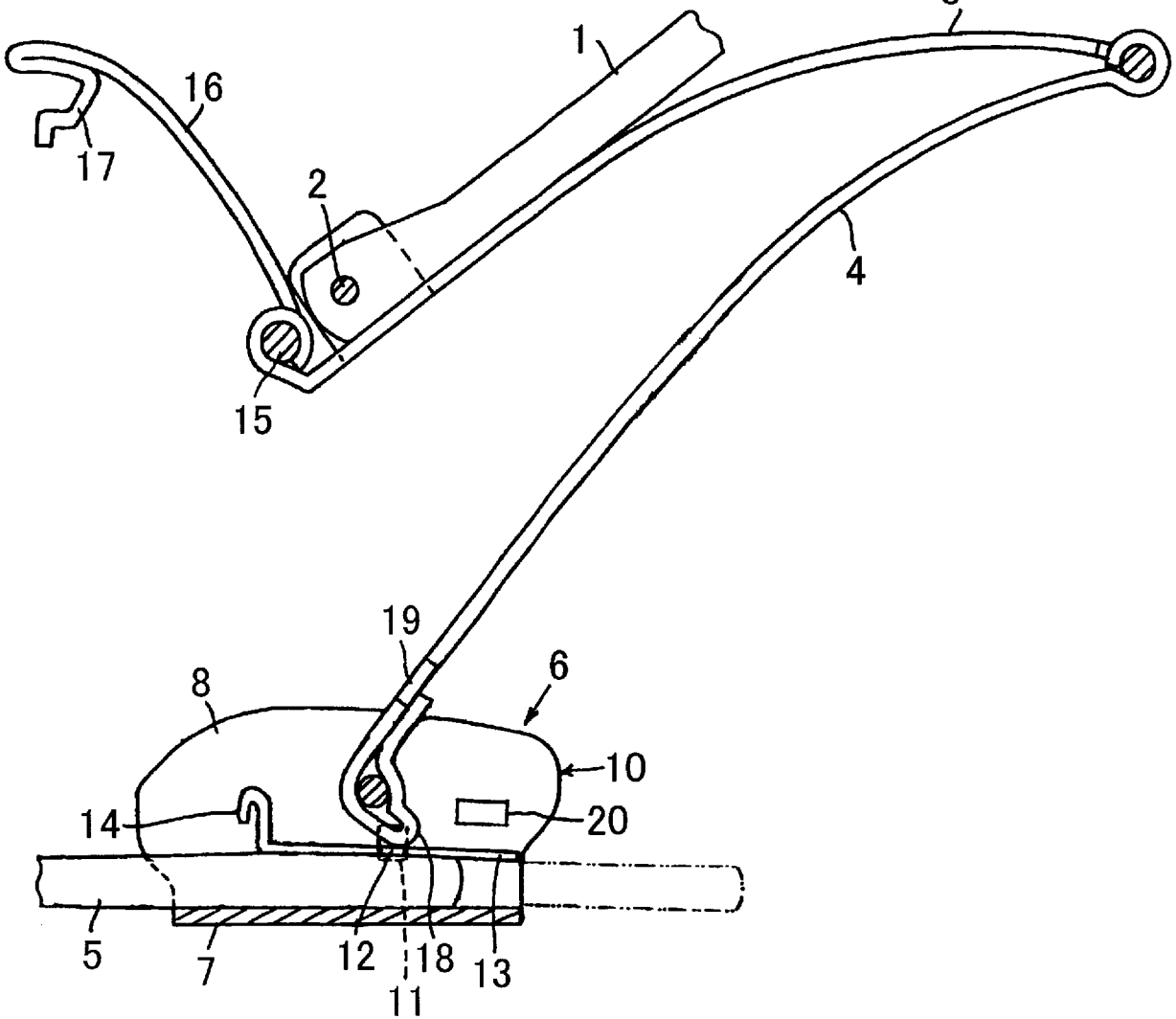
FIG. 22 is a sectional view of a conventional double-fold buckle.
Figure 23:
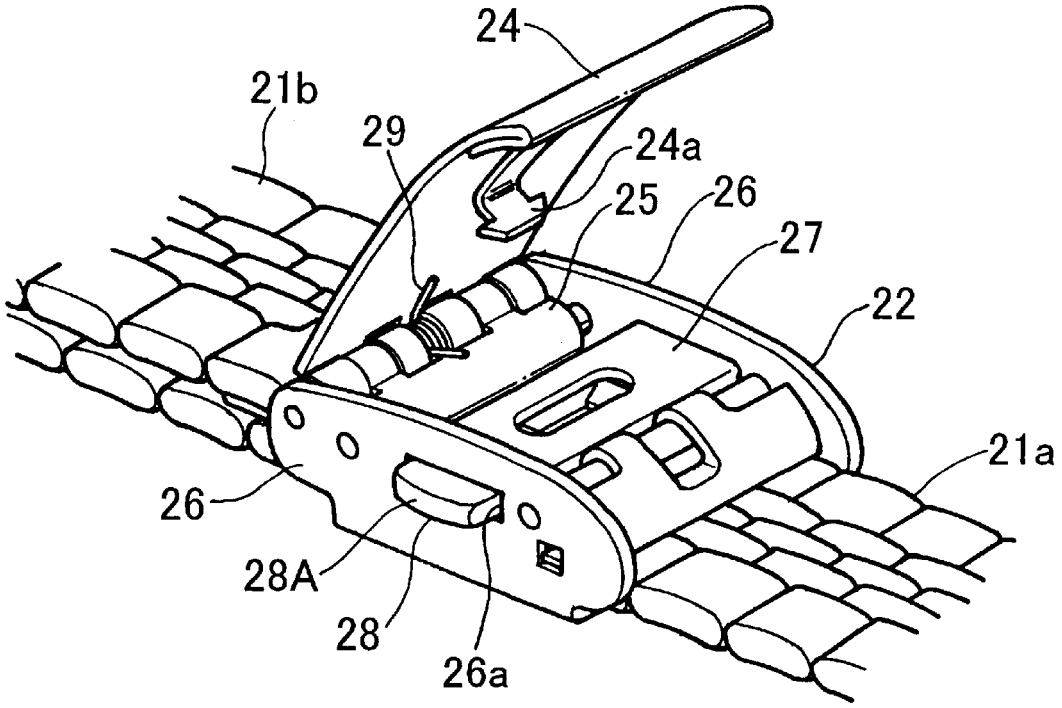
FIG. 23 is a perspective view of another conventional personal adornment band.
Figure 24:
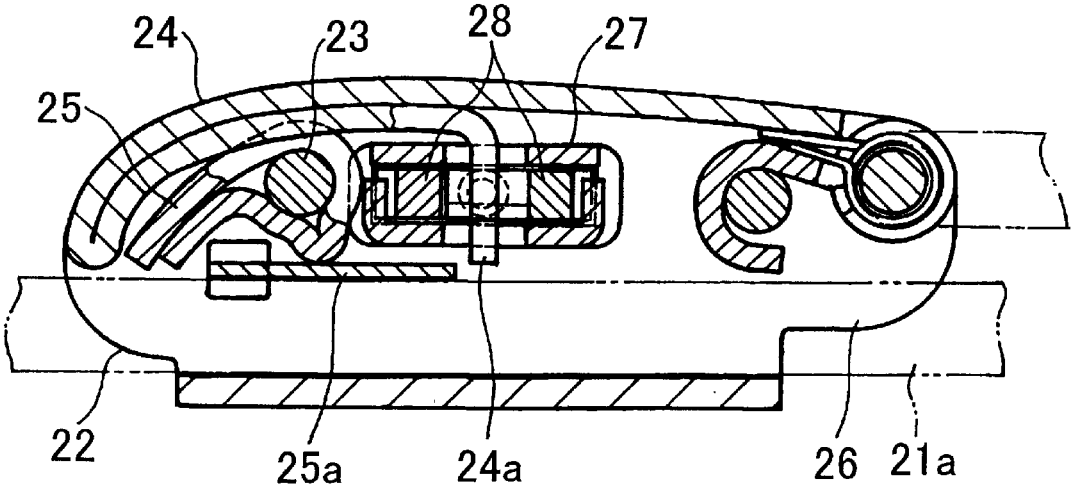
FIG. 24 is a sectional view of a buckle of the band of FIG. 23.

On the other hand, as shown in FIGS. 19 and 20, a slit 163 is formed in a bottom plate of the guide housing 151 instead of the hole in the sixth embodiment. As shown in FIG. 20, the spring portion 162 is inserted in the slit.

The operation is the same as that of the sixth embodiment.

The present embodiment is characterized in that the lugs 157 and 158 are formed at the front portions of the spring plate 155 and the abutting plate 156, the elongated hole 161 is also formed at the front portion of the side wall 160 opposite the lugs 157, 158, and the bottom plate of the guide housing has the slit 163 in which the spring portion 162 is to be inserted.

In the sixth embodiment, since the lugs 82 are formed at a base portion of the spring plate 83*b* and the abutting plate 83*a*, when the push plate 83 is depressed by the pushing projection 88 of the lower plate 75, the front portion of the push plate 83 is raised, thereby forming a gap between the band 76 and the plate 83. Hence such a problem that sand enters in the gap occurs.

To the contrary, in the seventh embodiment, the lugs 157 and 158 which serve as a fulcrum, and the elongated holes 161 are formed at the front portions of the push plate 152 and the side walls 160, so that the push plate is prevented from rising.

In addition, the spring portion 162 is disposed in the slit 163 of the guide housing so that the thickness of the buckle can be reduced by the thickness of the spring portion. Moreover, the spring portion is surrounded by the walls of the slit so that the fluctuation and horizontal displacement thereof are restricted.

PROBABILITY OF INDUSTRIAL EXPLOITATION

In accordance with the present invention, the excessive rotation of the pressing projection is prevented so that the buckle is not released, thereby preventing the personal adornment such as a wrist watch and bracelet from falling off the wearer's wrist. The lower plate 35 is not fixed to the side walls 39 of the buckle so that the lower plate can be rotated to release the buckle from the band without using a tool. Accordingly, the length of the band can be easily adjusted while wearing the personal adornment such as the watch and bracelet. Since another means for forcing the push plate to the lower plate is provided in addition to the pushing projection, the buckle and the band can be engaged more securely. Since the stopping position determining means is provided adjacent the pushing projection, the members can be accurately positioned with ease, so that the production is facilitated. In addition, none of the parts project out from the buckle, the cuffs of the cloth is not impaired. Moreover, in a watch having the buckle of the present invention for a band, the length of the band can be easily adjusted while the watch is worn on the wrist.

Since the spring for springing open the folded portions is concealed, the appearance of the buckle is not deteriorated.

What is claimed is:

1. A buckle for a personal adornment band comprising:

at least an upper plate and a lower plate pivotally connected to an end of a first band, and pivotally connected to each other;

a slidable frame having a bottom plate and a pair of side walls formed on both sides of the bottom plate and pivotally connected to an end of the lower plate;

a pushing projection formed at an end of the lower plate for fixing the slidable frame to a second band;

stopper means provided in the slidable frame so as to abut against the pushing projection at a position where the pushing projection fixes the slidable frame to the second band, thereby preventing the lower plate from rotating downwardly over the slidable frame fixing position.

2. The buckle according to claim 1 wherein the stopper means is provided at an outer position than the pushing projection.

3. The buckle according to claim 1 wherein the stopper means is provided at an inner position than the pushing projection.

4. The buckle according to claim 1 wherein the stopper means is a rod securely mounted between the side walls of the slidable frame.

5. The buckle according to claim 1 wherein the stopper means is projections formed on the side walls of the slidable frame.

6. The buckle according to claim 1 wherein the stopper means is a lock mechanism provided in the slidable frame.

7. The buckle according to claim 6 wherein the lock mechanism comprises a guide housing fixed in the slidable frame, a cover mounted on the upper plate, a hook formed on the underside of the cover projecting therefrom, a pair of push buttons slidable mounted in the guide housing and so disposed as to be depressable from the outside of the guide housing, a paid of springs for urging said push buttons outward, engaging portions provided on the push buttons for engaging with said hook, and a resilient member for urging the hook upwards.

8. The buckle according to claim 7 wherein the stopper means is the guide housing.

9. The buckle according to claim 7 wherein the guide housing has a slit in a bottom plate thereof where the resilient member is inserted.

10. The buckle according to claim 7 wherein said push plate is pushed by the hook so as to be depressed to the second band.

11. The buckle according to claim 7 wherein the push plate is supported by the side walls and movable in the direction of the thickness of the band at a front portion thereof.

12. The buckle according to claim 1 further comprising a push plate mounted on the slidable frame so as to insert the second band in a space between the bottom plate of the slidable frame and the push plate, and the push plate is pressed onto the second band by the pushing projection.

13. The buckle according to claim 12 further comprising pushing means provided on one of the lower plate and the push plate for pushing the push plate to the second band.

14. The buckle according to claim 12 wherein the pushing means is a ridge formed by bending the lower plate toward the push plate.

15. The buckle according to claim 13 wherein the pushing means is a rib formed on the push plate.

16. The buckle according to claim 13 wherein the first and second bands are made of plastic.

17. The buckle according to claim 16 wherein a plate curved into a shape of a C made of stainless is embedded in the bands so as to curve the bands in order to depress the second band toward the push plate when the buckle is released.

18. A buckle for a personal adornment band comprising:

at least an upper plate and a lower plate pivotally connected to an end of a first band, and pivotally connected to each other;

a slidable frame pivotally connected to an end of the lower plate;

pushing means provided on the lower plate so as to be pressed against a second band at a pressed position, thereby preventing the lower plate from rotating over the pressed position.

19. The buckle according to claim 18 wherein the pushing means is a pushing ridge formed on the lower plate by bending the lever plate toward the second band.

20. A buckle for a personal adornment band comprising:

at least an upper plate and a lower plate pivotally connected to an end of a first band, and pivotally connected to each other;

a slidable frame pivotally connected to an end of the lower plate;

a lock device provided in the slidable frame for locking the upper plate to the slidable frame;

a resilient member disposed under the lock device for upwardly urging the upper plate when the lock device is released.

21. The buckle according to claim 20 wherein the lock device includes at least one push button slidably mounted in the slidable frame and so disposed as to be depressable from the outside of the slidable frame, resilient means for urging said push button outward, an engaging portion provided on the push button for engaging with said upper plate due to the urging of the resilient means.

* * * * *